US006570339B1

(12) United States Patent
Moore

(10) Patent No.: US 6,570,339 B1
(45) Date of Patent: May 27, 2003

(54) COLOR FIBER-BASED PLASMA DISPLAY

(76) Inventor: Chad Byron Moore, 7 W. 4th St., Corning, NY (US) 14830

( * ) Notice: Subject to any disclaimer, the term of this patent is extended or adjusted under 35 U.S.C. 154(b) by 7 days.

(21) Appl. No.: 10/024,021

(22) Filed: Dec. 19, 2001

(51) Int. Cl.[7] ..... G09G 3/10

(52) U.S. Cl. ..... 315/169.3; 315/169.4; 313/485; 313/506; 313/582

(58) Field of Search ..... 315/169.4, 169.3, 315/167; 313/485, 486, 487, 495, 496, 497, 499, 503, 506, 582, 584, 585, 586, 587

(56) References Cited

U.S. PATENT DOCUMENTS

| | | | | |
|---|---|---|---|---|
| 3,602,754 | A | 8/1971 | Pfaender et al. | 313/108 |
| 3,611,019 | A | 10/1971 | Krembs | 313/201 |
| 3,790,849 | A | 2/1974 | Mayer et al. | 315/169 |
| 3,821,589 | A | 6/1974 | Katz et al. | 313/346 |
| 3,829,734 | A | 8/1974 | Schofield | 313/217 |
| 3,890,609 | A | 6/1975 | Sasaki et al. | 340/324 |
| 3,927,342 | A | 12/1975 | Bode et al. | 313/188 |
| 3,947,722 | A | 3/1976 | Strom et al. | 315/169 |
| 3,964,050 | A | 6/1976 | Mayer | 340/324 |
| 3,969,718 | A | 7/1976 | Strom | 340/324 |
| 3,990,068 | A | 11/1976 | Mayer et al. | 340/324 |
| 4,027,188 | A | 5/1977 | Bergman | 313/220 |
| 4,038,577 | A | 7/1977 | Bode et al. | 313/188 |
| 4,044,349 | A | 8/1977 | Andoh et al. | 340/324 |

(List continued on next page.)

OTHER PUBLICATIONS

C. Bergman, "Plasma Display Color Techniques Using Tubular Construction", AD766933 Final Report on Contract No. F30602–72–C–0167, Rome Air Development Center, Jul. 1973.

(List continued on next page.)

*Primary Examiner*—Don Wong
*Assistant Examiner*—Thuy Vinh Tran
(74) *Attorney, Agent, or Firm*—Brown & Michaels, PC

(57) ABSTRACT

An array of complex shaped top fibers that each include an address electrode, barrier ribs to form a plasma channel and a phosphor coating on the plasma channel create structure in a plasma display panel. The top fiber array is disposed on the plate facing the viewer and the light generated by the phosphors must penetrate through the top fibers to the viewer. The top fibers can be composed of a colored material associated with the color phosphor layer to add color purity and contrast to the plasma panel. The sustain electrodes are placed on the plate facing away from the viewer and can be included in an array of fibers containing wire sustain electrodes. The sustain electrode surface does not need to be transmissive since the generated light is transmitted through the top fiber array. Therefore, the sustain electrodes can be composed of a reflective metal and cover the majority of the surface of the bottom plate. Covering a large percentage of the bottom plate with sustain electrodes causes the maximum spreading of the electric field and generates the highest plasma efficiency. The sustain electrode bottom plate or array can also be reflective to reflect both the UV light generated by the plasma back toward the phosphor layer and the visible light generated by the phosphor layer back toward the viewer.

45 Claims, 19 Drawing Sheets

U.S. PATENT DOCUMENTS

| | | | | | |
|---|---|---|---|---|---|
| 4,554,537 | A | | 11/1985 | Dick | 340/775 |
| 4,728,864 | A | | 3/1988 | Dick | 315/169 |
| 4,737,687 | A | | 4/1988 | Shinoda et al. | 315/169 |
| 4,833,463 | A | | 5/1989 | Dick et al. | 340/775 |
| 5,086,297 | A | | 2/1992 | Miyake et al. | 340/759 |
| 5,436,634 | A | | 7/1995 | Kanazawa | 345/67 |
| 5,446,344 | A | | 8/1995 | Kanazawa | 315/169 |
| 5,458,519 | A | | 10/1995 | Lee et al. | 445/24 |
| 5,541,479 | A | | 7/1996 | Nagakubo | 313/586 |
| 5,661,500 | A | | 8/1997 | Shinoda et al. | 345/60 |
| 5,674,553 | A | | 10/1997 | Shinoda et al. | 427/68 |
| 5,745,086 | A | | 4/1998 | Weber | 345/63 |
| 5,838,105 | A | | 11/1998 | Mitomo | 313/582 |
| 5,984,747 | A | | 11/1999 | Bhagavatula et al. | 445/24 |
| 6,072,276 | A | | 6/2000 | Okajima | 313/581 |
| 6,247,987 | B1 | | 6/2001 | Moore | 445/24 |
| 6,354,899 | B1 | * | 3/2002 | Moore | 445/25 |
| 6,414,433 | B1 | * | 7/2002 | Moore | 313/582 |
| 6,424,400 | B1 | * | 7/2002 | Kawasaki | 349/149 |
| 6,452,332 | B1 | * | 9/2002 | Moore | 313/582 |

OTHER PUBLICATIONS

C. Bergman, R.W. Johnson, R.A. Strom and T.N. Thompson, "Large Screen Plasma Display", AD728623, Final Report on Contract No. F30602–70–C–0154, Rome Air Development Center, Jul. 1971.

R. A. Strom and C. Bergman, "Large Area Plasma Display module", AD782383, Final Report on Contract No. F30602–72–C–0211, Rome Air Development Center, Apr. 1974.

Trotter, D. M. et al., "PALC Displays MAde From Electroded Glass Fiber Arrays", SID '97 Digest, pp. 379–382.

Dick, G. W. "Three–Electrode per PEL AC Plasma Display Panel", 1985 International Display Research Conf., pp 45–50.

Moore, C. et al., "Fiber Plasma Display", SID '97 Digest, pp. 1055–1058.

Strom, R., 1974, "32–Inch Graphic Plasma Display Module", SID Int. Symposium, San Diego, pp 122–123.

* cited by examiner

COLOR FIBER-BASED PLASMA DISPLAY

BACKGROUND OF THE INVENTION

1. Field of the Invention

The invention pertains to the field of plasma display panels. More particularly, the invention pertains to using glass structures, such as fiber, to construct a color plasma display panel.

2. Description of Related Art

Plasma display panels (PDP) have been around for about 30 years, however they have not seen widespread commercial use. The main reasons are the short lifetime, low efficiency, and cost of the color plasma displays. Most of the performance issues were solved with the invention of the three electrode surface discharge AC plasma display (G. W. Dick, "Three-Electrode per PEL AC Plasma Display Panel", 1985 International Display Research Conf., pp. 45–50; U.S. Pat. Nos. 4,554,537, 4,728,864, 4,833,463, 5,086,297, 5,661,500, and 5,674,553). The new three electrode surface discharge structure, shown in FIG. 1, advances many technical attributes of the display, but its complex manufacturing process and detailed structure makes manufacturing complicated and costly.

Currently, plasma display structures are built up layer by layer on specialty glass substrates using many complex processing steps. FIG. 1 illustrates the basic structure of a surface discharge AC plasma display made using standard technology. The PDP can be broken down into two parts: top plate 10 and bottom plate 20. The top plate 10 has rows of paired electrodes referred to as the sustain electrodes 11*a*, 11*b*. The sustain electrodes are composed of wide transparent indium tin oxide (ITO) electrodes 12 and narrow Cr/Cu/Cr bus electrodes 13. These electrodes are formed using sputtering and multi-layer photolithography. The sustain electrodes 11 are covered with a thick (25 $\mu$m) dielectric layer 14 so that they are not exposed to the plasma. Silk-screening a high dielectric paste over the surface of the top plate and consolidating it in a high temperature process step forms this dielectric layer 14. A magnesium oxide layer (MgO) 15 is deposited by electron-beam evaporation or sputtering over the dielectric layer to enhance secondary emission of electrons and improve display efficiency. The bottom plate 20 has columns of address electrodes 21 formed by silk-screening silver paste and firing the paste in a high temperature process step. Barrier ribs 22 are then formed between the address electrodes 21. These ribs 22, typically 50 $\mu$m wide and 120 $\mu$m high, are formed using either a greater than ten layer multiple silk-screening process, embossing a frit paste, or a sandblasting process. In the sandblasting method, barrier rib paste is blade coated on the glass substrate. A photoresist film laminated on the paste is patterned by photolithography. The rib structure is formed by sandblasting the rib paste between the exposed pattern, followed by removal of the photoresist layer and a high temperature consolidation of the barrier rib 22. Alternating red 23R, green 23G, and blue 23B phosphors are silk-screened into the channels between the barrier ribs to provide color for the display. After silk-screening the phosphors 23, the bottom plate is sandblasted to remove excess phosphor in the channels. The top and bottom plates are frit sealed together and the panel is evacuated and backfilled with a gas mixture containing xenon.

The basic operation of the display requires a plasma discharge where the ionized xenon generates ultraviolet (UV) radiation. This UV light is absorbed by the phosphor and emitted as visible light. To address a pixel in the display, an AC voltage is applied across the sustain electrodes 11, which is large enough to sustain a plasma, but not large enough to ignite one. A plasma is a lot like a transistor, as the voltage is increased nothing happens until a specific voltage is reached where it turns on. Then an additional short voltage pulse is applied to the address electrode 21, which adds to the sustain voltage and ignites the plasma by adding to the total local electric field, thereby breaking down the gas into a plasma. Once the plasma is formed, electrons are pulled out of the plasma and deposited on the MgO layer 15. These electrons are used to ignite the plasma in the next phase of the AC sustain electrodes. To turn the pixel off, an opposite voltage must be applied to the address electrode 21 to drain the electrons from the MgO layer 15, thereby leaving no priming charge to ignite the plasma in the next AC voltage cycle on the sustain electrodes. Using these priming electrons, each pixel can be systematically turned on or off. To achieve gray levels in a plasma display, each video frame is divided into 8 bits (256 levels) and, depending on the specific gray level, the pixels are turned on during these times.

A number of methods have been proposed to create the structure in a plasma display, such as thin and thick film processing, photolithography, silk screening, sand blasting, and embossing. However, none of the structure forming techniques provides as many advantages as using fibers. Small hollow tubes were first used to create structure in a panel by W. Mayer, "Tubular AC Plasma Panels," 1972 IEEE Conf. Display Devices, Conf. Rec., New York, pp. 15–18, and R. Storm, "32-Inch Graphic Plasma Display Module," 1974 SID Int. Symposium, San Diego, pp. 122–123, and included in U.S. Pat. Nos. 3,964,050 and 4,027,188. These early applications were focused on using an array of gas filled hollow tubes to produce the rib structure in a plasma display panel. In addition, this work focused on adding the electrode structure to the glass plates that sandwiched the gas filled hollow tubes.

Since this early investigation, no further work was published on further developing a fiber or tube technology until C. Moore and R. Schaeffler, "Fiber Plasma Display", SID '97 Digest, pp. 1055–1058. This work integrated the wire electrode(s) into glass fibers to produce the structure in a display, as shown in FIG. 2. U.S. Pat. No. 5,984,747, issued Nov. 16, 1999, entitled "GLASS STRUCTURES FOR INFORMATION DISPLAYS", was granted covering this technology. Another fiber-based plasma display patent application, Ser. No. 09/299,370, filed on Apr. 26, 1999, entitled "FIBER-BASED PLASMA DISPLAYS", covers many different additions to the structure in the fiber-based plasma display and is incorporated herein by reference. The manufacturing of the plasma display covered under U.S. Pat. No. 6,247,987, issued Jun. 19, 2001, entitled "PROCESS FOR MAKING ARRAY OF FIBERS USED IN FIBER-BASED DISPLAYS", and patent application, Ser. No. 09/299,371, filed Apr. 26, 1999, entitled "FRIT-SEALING PROCESS USED IN MAKING DISPLAYS", allow for the manufacturing of any multiple strand arrayed plasma display and are incorporated herein by reference.

There are several advantages to creating plasma displays using arrays of fibers. The largest advantage is a reduction in the manufacturing costs of the panel of over a factor of two with a five times less capital cost requirement. These economical advantages result from manufacturing process with no multi-level alignment process steps, no need for large area vacuum deposition equipment, about ½ the process steps (potentially leading to higher yields), simpler process steps (hot glass extrusion, fiber draw, and phosphor spraying compared to photolithography, precision silk screening, and vacuum deposition processes) and the ability to create many different size displays using the same manufacturing equipment. Although using fibers to create the structure in a display has drastically simplified the manufacturing of the panel leading to a large reduction in manufacturing cost, there have been no advancements to the performance of the display. Plasma displays still suffer from low luminous efficiencies and poor color purity, mainly due to a lack of blue phosphor. NEC Corporation has been fabricating plasma displays using a color filter contained within the top plate and aligning the color filter with the corresponding phosphor colors in the bottom plate, as described in U.S. Pat. No. 6,072,276, issued Jun. 6, 2000, entitled "COLOR PLASMA DISPLAY PANEL AND METHOD OF MANUFACTURING THE SAME". The addition of a color filter has created a display with a much higher color purity and higher bright room contrast. Adding color filters to plasma displays was first patented by Pioneer Electronic Corporation in U.S. Pat. No. 5,838,105, issued Nov. 17, 1998, entitled "PLASMA DISPLAY PANEL INCLUDING COLOR FILTERS".

This patent describes a new fiber-based plasma display that economically incorporates a color filter and whose structure is designed to yield the maximum luminous efficiency.

SUMMARY OF THE INVENTION

The invention includes an array of complex shaped top fibers which each contain an address electrode, barrier ribs to form a plasma channel and a phosphor coating on the plasma channel to create the structure in a plasma display panel. The top fiber array is disposed on the plate facing the viewer and the light generated by the phosphors must penetrate through the top fibers to the viewer. The top fibers can be composed of a colored material associated with the color phosphor layer to add color purity and contrast to the plasma panel. The sustain electrodes are placed on the plate facing away from the viewer and can be included in an array of fibers containing wire sustain electrodes. Since the light is transmitted through the top fiber array the sustain electrode surface does not have to be transmissive. Therefore, the sustain electrodes can be composed of a reflective metal and cover the majority of the surface of the bottom plate. Covering a large percentage of the bottom plate with sustain electrodes causes the maximum spreading of the electric field and generates the highest plasma efficiency. The sustain electrode bottom plate or array can also be reflective to reflect both the UV generated by the plasma back toward the phosphor layer and the visible light generated by the phosphor layer back toward the viewer.

DETAILED DESCRIPTION OF THE INVENTION

In the following description, the term "top" refers to the section or sections of a panel in a display that is closest to the viewer, whereas "bottom" refers to the section or sections of a panel in the side of the display that is away from the viewer.

Figure 3:
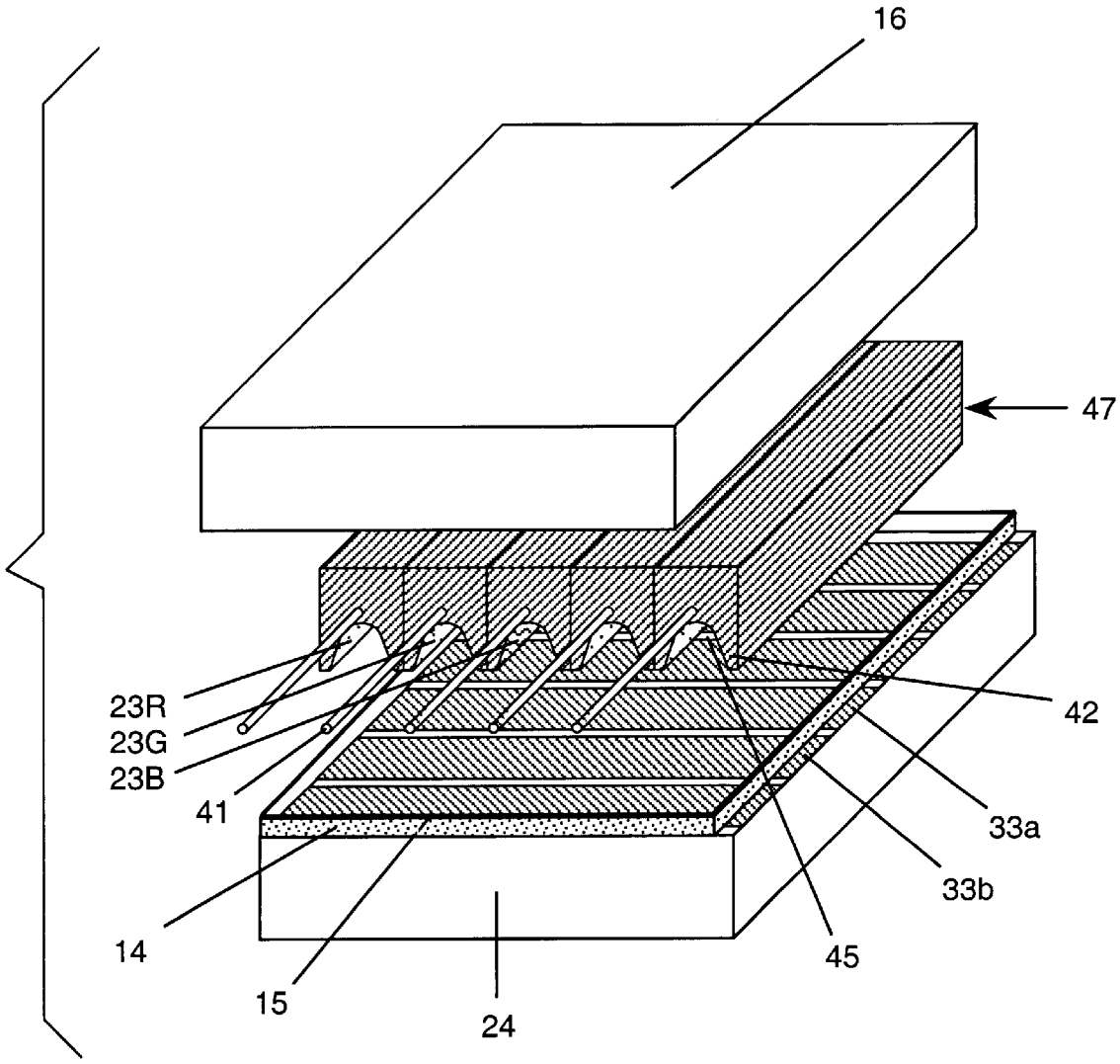
FIG. 3 illustrates a fiber-based plasma display composed of an array of fibers containing the phosphor coatings on the side facing the viewer.
Figure 4:
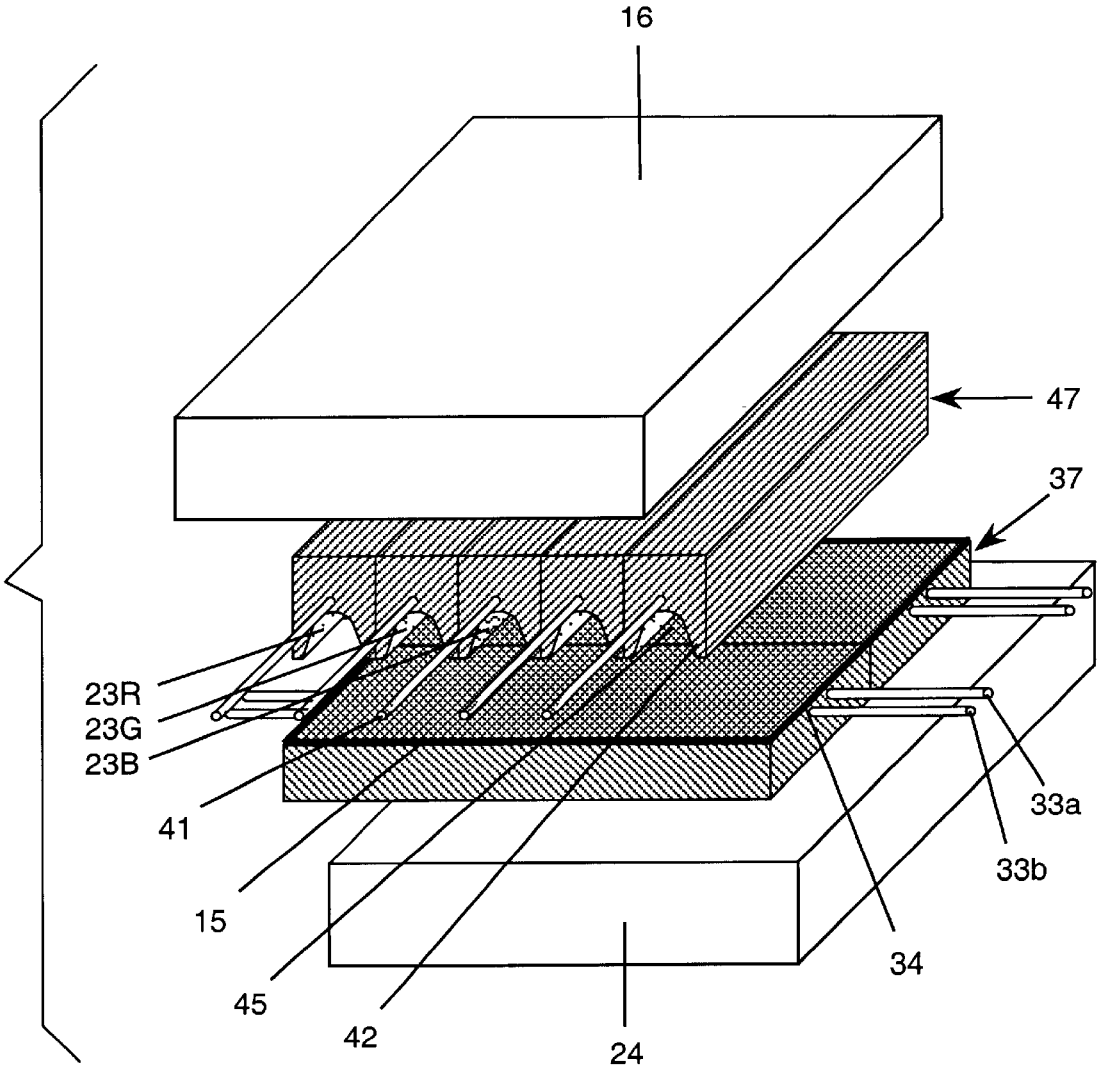
FIG. 4 illustrates a fiber-based plasma display composed of an array of fibers containing the phosphor coatings on the side facing the viewer and an array of fibers containing the sustain electrodes.

Referring now to FIGS. 3 and 4, a color fiber-based plasma display of the present invention has an array of fibers 47 where each fiber contains the address electrode 41, barrier ribs 42, plasma channel 45 and the phosphor layer 23. The fiber array 47 is located on the side facing the viewer. Placing this array 47 on the side facing the viewer requires that there is high transmission through the fiber 47 and that the phosphor layer 23 is at a given thickness and is very uniformly deposited in the plasma channel 25. FIG. 3 shows that the top fiber array 47 can be sandwiched between a top glass plate 16 and a bottom plate 24 containing the sustain electrodes 33*a* and 33*b*. FIG. 4 shows that the structure on the bottom plate 24 can be contained in a bottom fiber array 37 to create a total-fiber plasma display. Since light is transmitted out through the top of the display the bottom plate is not required to be transmissive, and therefore, can be composed of metal, glass, ceramic, glass-ceramic or even plastic.

There are several advantages to fabricating a color fiber-based plasma display with the fiber array 47 containing the phosphors 23 facing the viewer. The color emitted from the phosphors 23 can be seen directly by the viewer without being transmitted through the sustain electrodes where some of the light is blocked and absorbed. A color filter, corresponding to phosphor color (23R, 23G or 23B), can be added to the top fibers 47 to enhance the color purity and color contrast of the display, as discussed in FIGS. 11 and 12 below. Wide sustain electrodes 33 can be used to spread out the plasma firing, in turn increasing the efficiency of the plasma. The sustain electrodes 33 or bottom fibers 37 can be reflective to reflect the light generated by the phosphors back towards the viewer. A coating could also be applied over the sustain electrodes to reflect the ultraviolet light generated by the plasma toward the phosphors 2. Lastly, since the entire functionality is contained within each fiber, no alignment between top fibers 47 is required.

Figure 5:
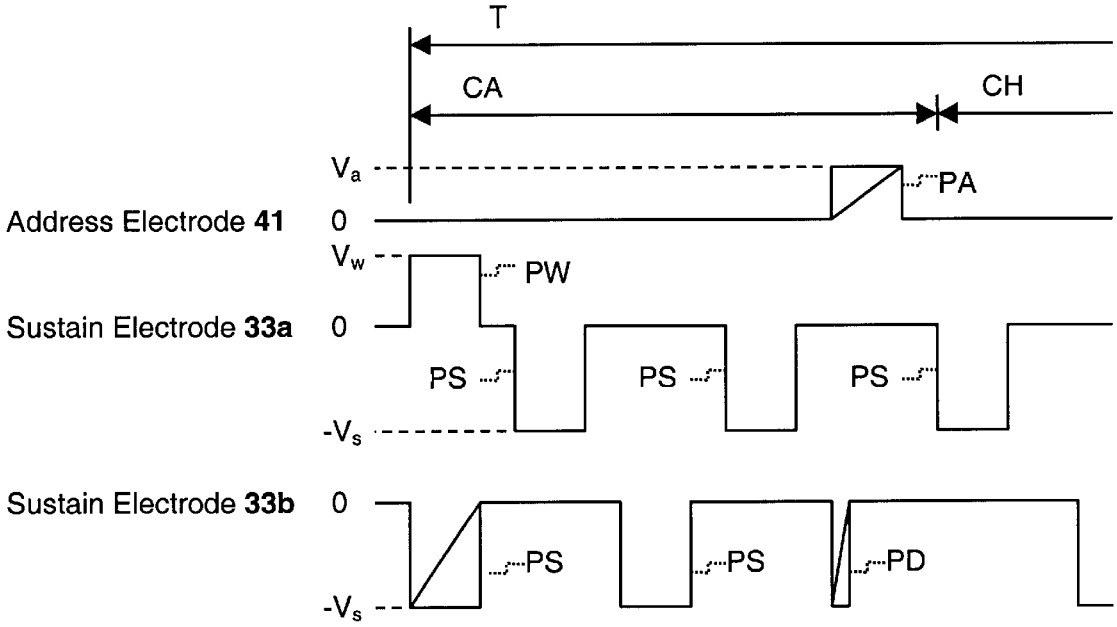
FIG. 5 shows the voltage waveforms for the erase address mode of operation.

There are presently three address modes of operation for a traditional AC plasma display: (1) erase address (U.S. Pat. No. 5,446,344), (2) write address (U.S. Pat. No. 5,661,500), and (3) ramped voltage address (U.S. Pat. No. 5,745,086). These addressing modes of operation differ in the color fiber-based plasma displays shown in FIGS. 3 and 4 in that the voltage waveforms are applied to different plates (i.e. the sustain voltages are applied to the bottom plate and the address voltages are applied to the top plate). The voltage waveforms for the matrix erase address waveform is shown in FIG. 5. In the initial address cycle CA in the line display period T, a discharge sustain pulse PS is applied to the sustain electrode 33*a* and simultaneously a writing pulse in applied to the display sustain 33*b*. In FIG. 5, the inclined line in the discharge sustain pulse PS indicates that it is selectively applied to lines. By this operation, all surface discharge cells placed in a written state.

After the discharge sustain pulses PS are alternately applied to the display electrodes 33*a* and 33*b* to stabilize the written states, and at an end stage of the address cycle CA, an erase pulse PD is applied to the display electrode 33*b* and a surface discharge occurs.

The erase pulse PD is short in pulse width, 1 $\mu$s to 2 $\mu$s. As a result, wall charges on a line as a unit are lost by the discharge caused by the erase pulse PD. However, by timing the erase pulse PD with a positive electric field control pulse PA having a wave height Va applied to address electrodes 41, the corresponding unit luminescent pixel elements stays charged.

In the unit luminescent pixel elements where the electric field control pulse PA is applied, the electric field due to the erase pulse PD is neutralized so that the surface discharge for erasure is prevented and the wall charges necessary for display remain. More specifically, addressing is performed by a selective erasure in which the written states of the surface discharge cells to be illuminated are kept.

In the display period CH following the address cycle CA, the discharge sustain pulse PS is alternately applied to the display electrodes 33*a* and 33*b* to illuminate the phosphor layers 23. The display of an image is established by repeating the above operation for all line display periods.

Figure 6:
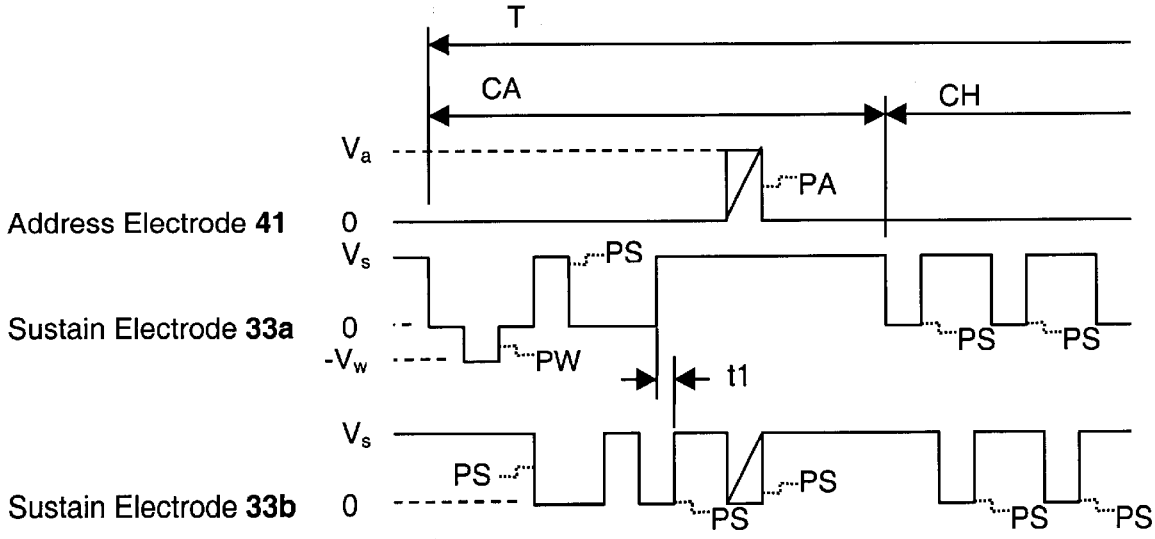
FIG. 6 shows the voltage waveforms for the write address mode of operation.

The voltage waveforms for the matrix write address waveform is shown in FIG. 6. At the initial stage of the address cycle CA, a writing pulse PW is applied to the display electrode 33*a* at the same time a sustain pulse is applied to display electrode 33*b* so as to make the potential thereof large enough to place each pixel element in the line in a write state. The write pulse PW is followed by two sustain pulses PS to condition the plasma cells. A narrow relative pulse of width t1 is then applied to each pixel element in the line to erase the wall charge. The narrow pulse is obtained by applying a voltage Vs on the sustain electrode 33*a* a time t1 before a voltage Vs is applied to sustain electrode 33*b*. In the display line, a discharge sustain pulse PS is selectively applied to the display electrode 33*b* and a selective discharge pulse PA is selectively applied to the address electrodes 41 corresponding to the unit luminescent pixel elements to be illuminated in the line depending on the image. By this procedure, opposite discharges between the address electrodes 41 and the sustain electrode 33*b* or selective discharges occur, so that the surface discharge cells corresponding to the unit luminescent pixel elements to be illuminated are placed into write states and the addressing finishes.

In the display period CH following the address cycle CA, the discharge sustain pulse PS is alternately applied to the sustain electrodes 33*a* and 33*b* to illuminate the phosphor layers 23. The display of an image is established by repeating the above operation for all line display periods.

Figure 7:
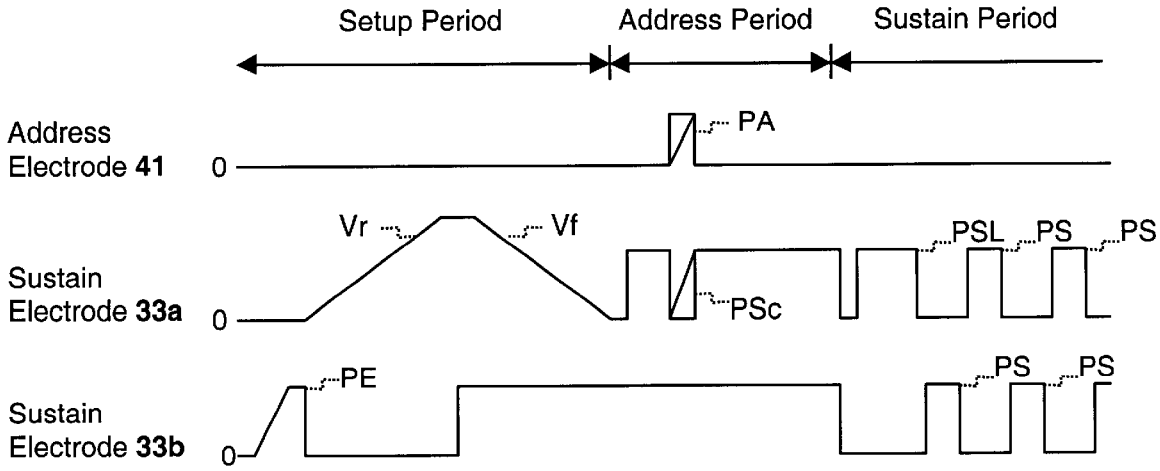
FIG. 7 shows the voltage waveforms for the ramped voltage address mode of operation.

The voltage waveforms for the matrix ramped voltage address waveform is shown in FIG. 7. During the setup period a voltage ramp PE is applied to the sustain electrode 33*b* which acts to erase any pixel sites which are in the ON state. After the initial erase a slowly rising ramp potential Vr is applied to the sustain electrode 33*a* then raised potential is applied to sustain electrode 33*b* and a falling potential Vf is applied to the sustain electrode 33*a*. The rising and falling voltages produces a controlled discharge causing the establishment of standardized wall potentials at each of the pixel sites along the sustain line. During the succeeding address pulse period, address data pulses PA are applied to selected column address lines 41 while sustain lines 33*a* are scanned PSc. This action causes selective setting of the wall charge states at pixel sites along a row in accordance with applied data pulses.

Thereafter, during the following sustain period an initial longer sustain pulse PSL is applied to the sustain electrode 33*a* to assure proper priming of the pixels in the written state. The remaining sustaining period is composed of discharge sustain pulses PS alternately applied to the sustain electrodes 33*a* and 33*b* to illuminate the phosphor layers 23. The display of an image is established by repeating the above operation for all line display periods.

Any of these three modes of addressing could be used to either progressively address the display or to address the display using an interlaced mode of addressing where every other line in the display is addressed per frame.

Figure 8:
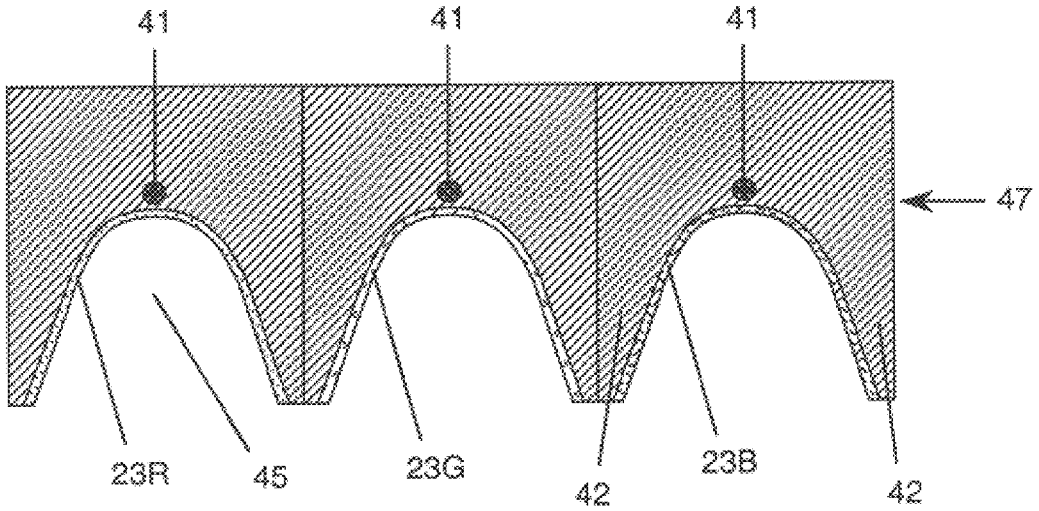
FIG. 8 schematically shows a cross-section of a top fiber array with all three color phosphor layers and built-in plasma addressing electrodes.

FIG. 8 is a cross-sectional schematic of the top fiber array 47 as discussed above in FIGS. 3 and 4. Each individual fiber is comprised of a wire address electrode 41, a pair of barrier ribs 42 that form a plasma channel 45, where the surface of the plasma channel 45 is coated with a phosphor layer 23R, 23G or 23B corresponding to a red, green or blue phosphor color, respectively. Note that since the entire functionality of the phosphor emissive plate is contained within each fiber, no alignment between top fibers 47 is required.

Figure 9:
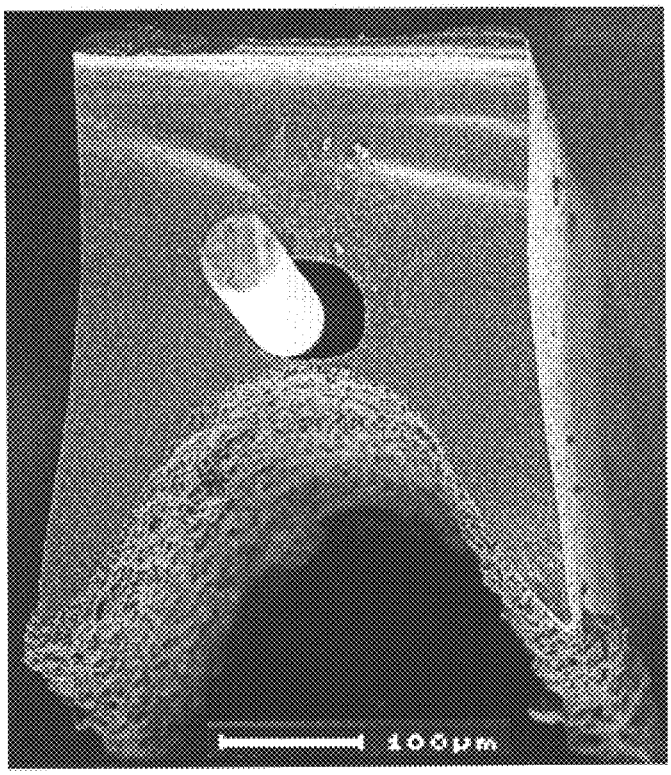
FIG. 9 is a cross-sectional SEM of a top fiber showing the uniformity in the phosphor coating across the entire surface of the plasma channel.

An SEM micrograph of a top fiber is shown in FIG. 9. The phosphor coating thickness is very uniform across the plasma channel. The uniform phosphor coating was applied using a spraying process as discussed in U.S. Pat. No. 6,247,987, issued Jun. 19, 2001, entitled "PROCESS FOR MAKING ARRAY OF FIBERS USED IN FIBER-BASED DISPLAYS", which is incorporated herein by reference. A uniform phosphor thickness is key to creating a high quality plasma display with high brightness. The phosphor layer has to be thick enough to absorb all the incident UV light, but thin enough to allow the converted colored light to escape through the phosphor layer. The best example of this UV light absorption and visible light reemission through a phosphor layer is a fluorescent tube. Fluorescent tubes are cylindrical glass tubes with phosphor coatings on the inside walls of the tube. The tube ends are sealed and contain electrodes. The tubes are filled with a mercury (Hg) containing gas. Applying an AC voltage to the electrodes creates a plasma inside the tube, which generates UV light. The UV light impinging on the phosphor layer is absorbed, converted to white light, and re-emitted. In order for the white light to reach the outside of the tube it has to penetrate through the remaining phosphor layer.

Figure 10:
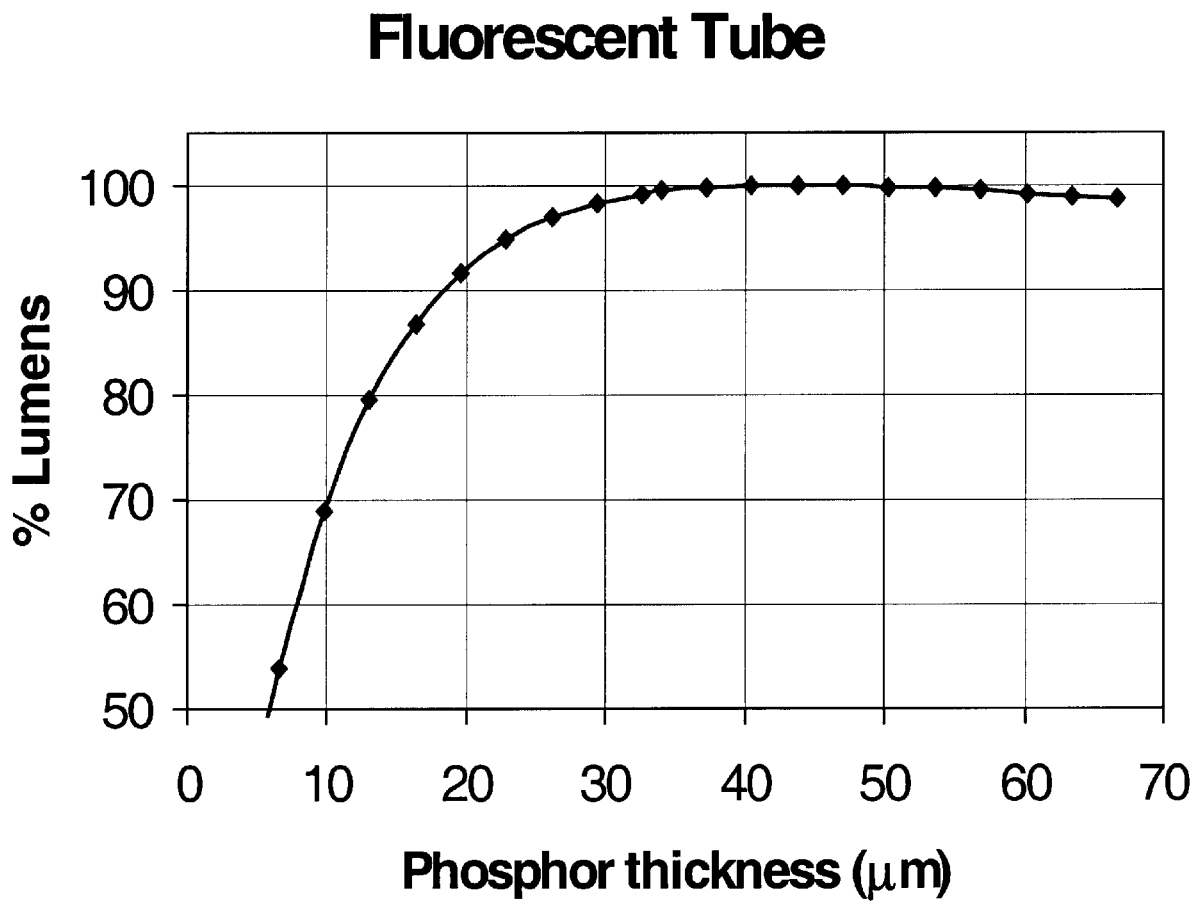
FIG. 10 is a graph of percent lumens versus phosphor thickness for a fluorescent tube.

The percent lumens, or percent of white light exiting the tube, versus phosphor layer thickness for a typical fluorescent tube is shown in FIG. 10. Thin phosphor layers do not have enough phosphor to absorb the UV generated by the plasma, whereas thick phosphor layers start to reabsorb the converted white light and block it from exiting the fluorescent tube. There is an optimum phosphor thickness that allows for the maximum amount of UV light to be absorbed and transmitted to white light. This same UV light absorption and light generation is required for the color fiber-based plasma display of the present invention. The difference is that the UV light generated in a plasma display typically comes from xenon, which produces a higher energy UV light than that of mercury. This higher energy UV light is absorbed in a thinner phosphor layer, thus shifting the curve in FIG. 10 to thinner phosphor layer thicknesses. It is most important to control the thickness uniformity of the blue phosphor in a plasma display because the tail-off, or decrease in percent lumens, at thicker phosphor layers is sharper as a result of a higher absorption at the higher photon energies. Red light from the red phosphors penetrates much further than green or blue light.

Figure 11:
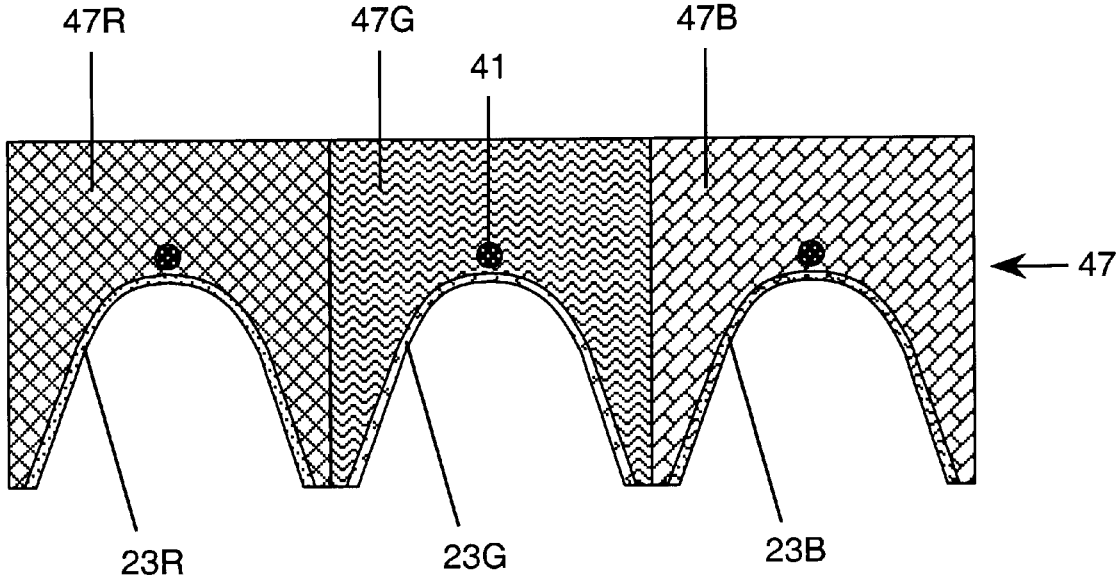
FIG. 11 schematically shows a cross-section of a top fiber array comprised of sequentially colored top fibers.
Figure 12:
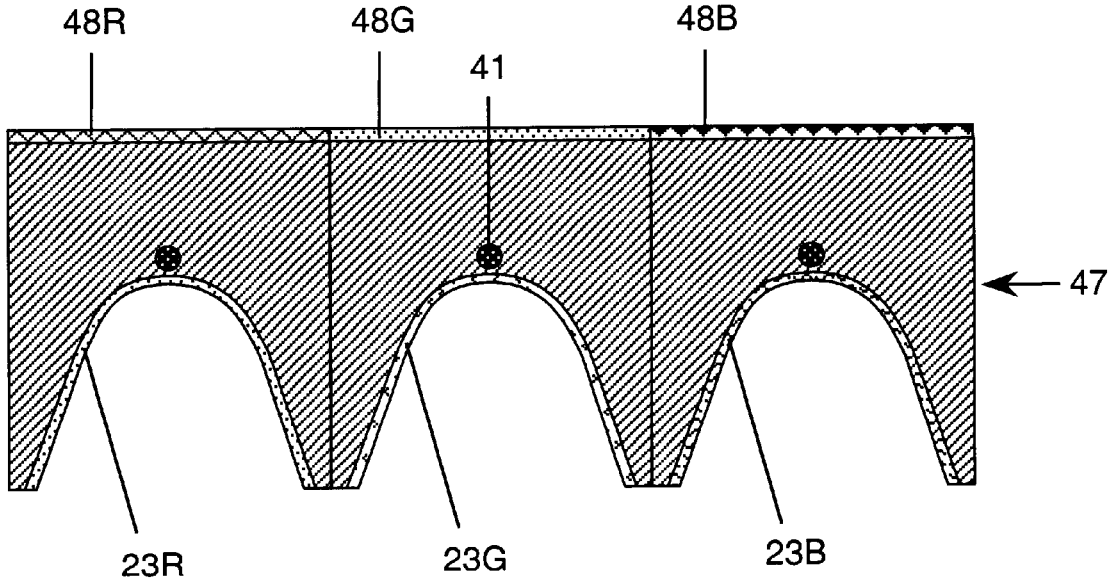
FIG. 12 schematically shows a cross-section of a top fiber array with a sequential red, green, and blue color filter coating on the surface of the fibers.

To enhance the color purity of the display, a color filter can be added to the top fibers 47 as shown in FIG. 11 and 12. Adding a color filter to the top fibers not only improves the color purity of the red, green and blue light being emitted from of the display, but also improves the contrast of the display. Contrast enhancement results from the color filter absorbing incident or transmitted light that is outside the spectral characteristics of the color filter, while transmitting the colored light associated with its given phosphor layer 23R, 23G or 23B. FIG. 11 shows that a color filter can be added to the display by making the fibers 47R, 47G, and 47B out of colored glass. It is not important to match the thermal expansion of each of the three color fibers 47R, 47B and 47G, since they are only attached to the glass plates at their ends. Therefore, the composition of the glass comprising each color fiber can be optimized to produce the purest red, green, and blue color filter material. FIG. 12 shows that the color filter can be added to the display by adding a color coating 48R, 48G, and 48B to the surface of the fibers 47. This coating can be an inorganic or an organic coating and can be added to the fiber before, during or after the fiber draw process.

Figure 13:
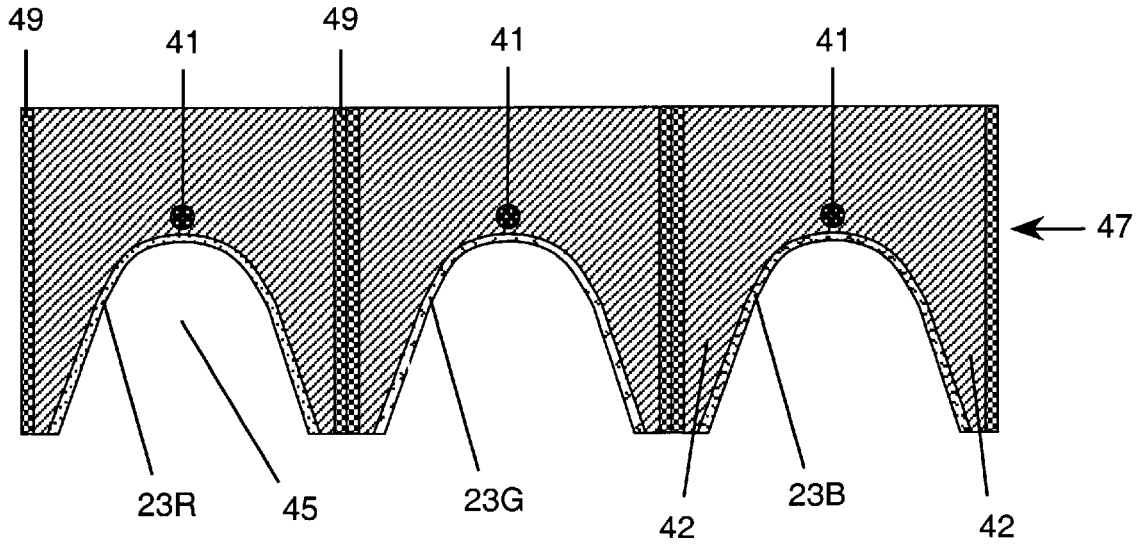
FIG. 13 schematically shows a cross-section of a top fiber array with a reflective coating on the sides of the fibers to contain the specific color light within its fiber.
Figure 14:
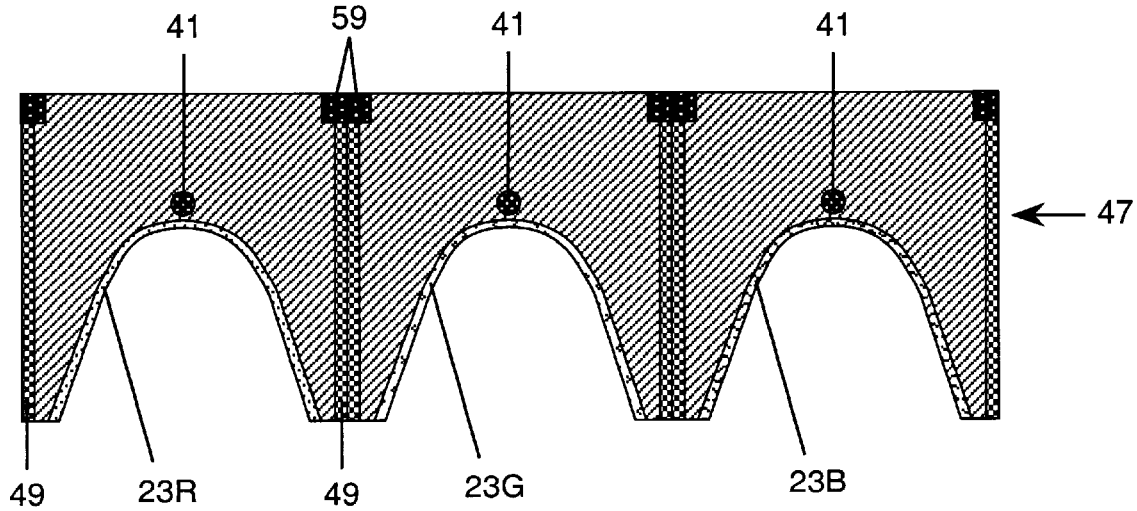
FIG. 14 schematically shows a cross-section of a top fiber array with a black matrix built into the sides of the fibers.

To prevent light generated in one fiber from spreading into the next fiber, a light barrier 49 can be applied to the sides of the top fibers 47, as shown in FIGS. 13 and 14.

These light barriers 49 can be absorbing, reflective, or a combination of both absorbing and reflective. Absorbing light barriers 49 also function as a black matrix 59 helping to define one color from the next. Reflecting light barriers 49 keep the colored light confined to its specific fiber. A reflecting light barrier 49 is very beneficial in channeling light generated at the bottom of the fiber 47 out toward the viewer. The light barrier 49 can be composed of an inorganic or organic material or a metal film and can be applied to the fiber before, during or after the fiber draw process. The light barrier 49 layer can be composed of an opal glass that is added to the initial preform before the fiber draw process. The light barrier layer 49 could also be a mixture of small reflecting particles, such as $TiO_2$ or $Al_2O_3$, mixed with the base glass or a glass that forms an expansion match with the base glass when the particles are contained within it and the mixture added to the sides of the initial preform before the fiber draw process. Small reflecting particles, such as $TiO_2$ or $Al_2O_3$, could be sprayed on the sides of the fiber 47 during or after the fiber draw process to form the light barrier layer 49. A metal coating could also be used to form the light barrier layer 49. A metal layer would also serve to confine the electric field generated during the firing of the plasma.

Figure 15:
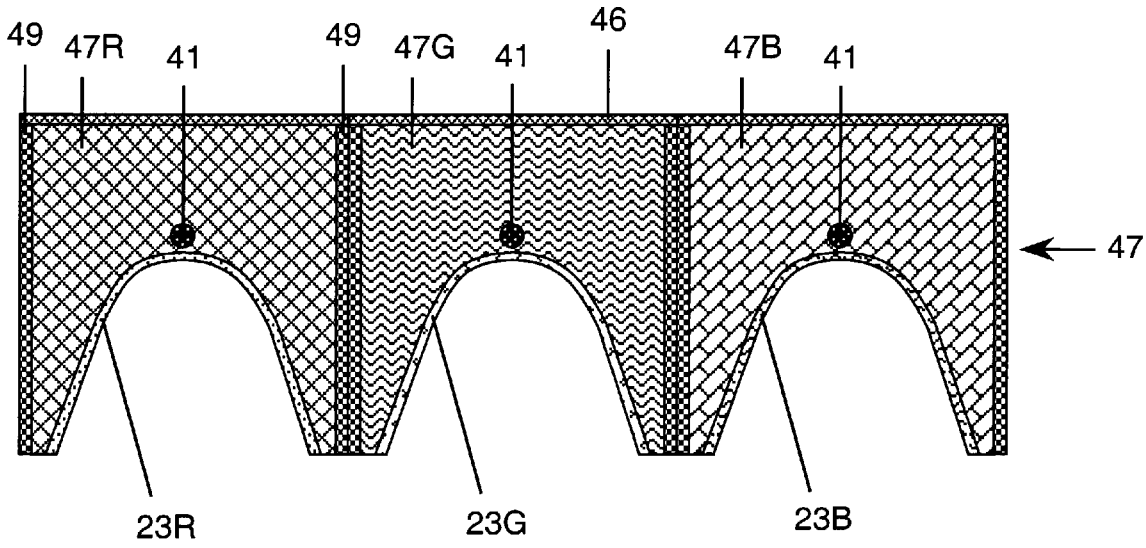
FIG. 15 schematically shows a cross-section of a top fiber array with a neutral density filter coating on the surface of the fibers.
Figure 16:
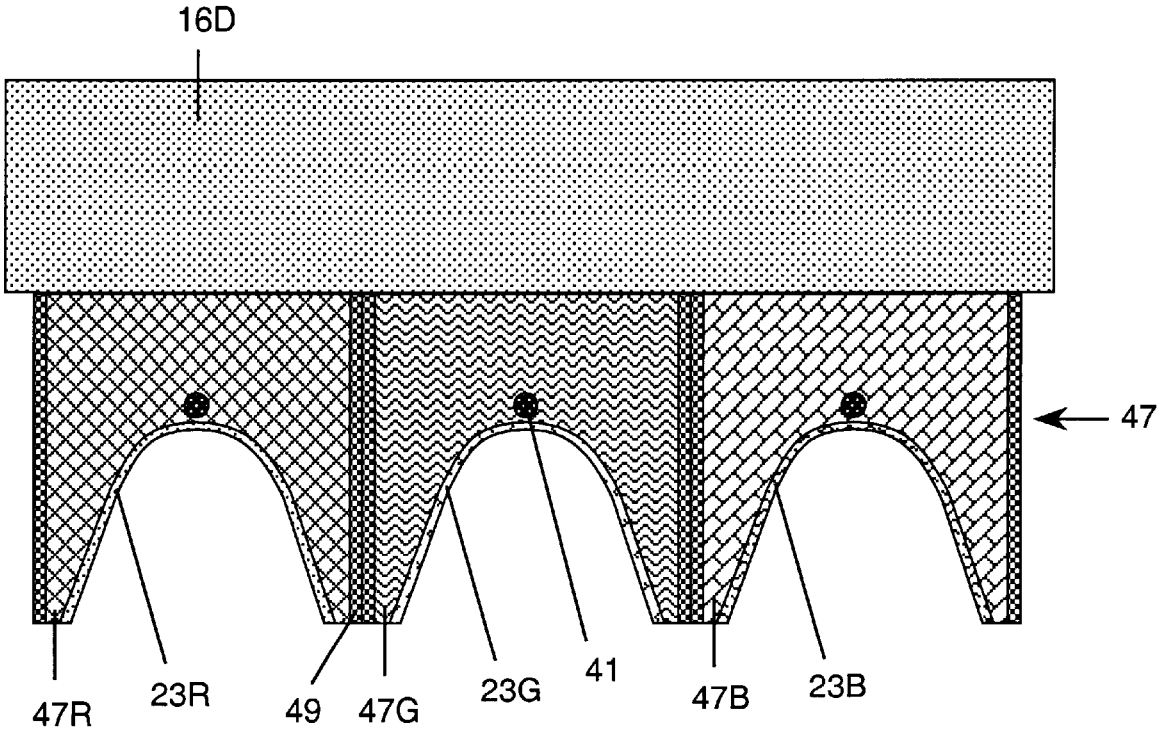
FIG. 16 schematically shows a cross-section of a top fiber array in contact with a low light transmission top plate that serves as a neutral density filter.

Referring now to FIG. 15, a neutral density filter 46 or absorbing layer can be added to the top fibers 47 to reduce the reflection from the phosphors and interfaces. Thus, the bright room contrast of the display is increased. Accordingly, the top glass plate 16D, shown in FIG. 16, could be absorbing to serve as a neutral density filter. Cathode Ray Tubes use a front plate panel with between 40% to 80% transmission to reduce the reflection from the phosphors, thus increase the bright room contrast. The theory behind a neutral density filter is that the ambient room light has to pass through the neutral density filter twice, whereas emitted light only has to pass through the filter once. If the top fibers 47R, 47G and 47B are composed of a color glass to form a color filter, they serve as a filter for ambient light outside its transmission band. Therefore, a neutral density filter with only slight absorption is required.

Figure 17:
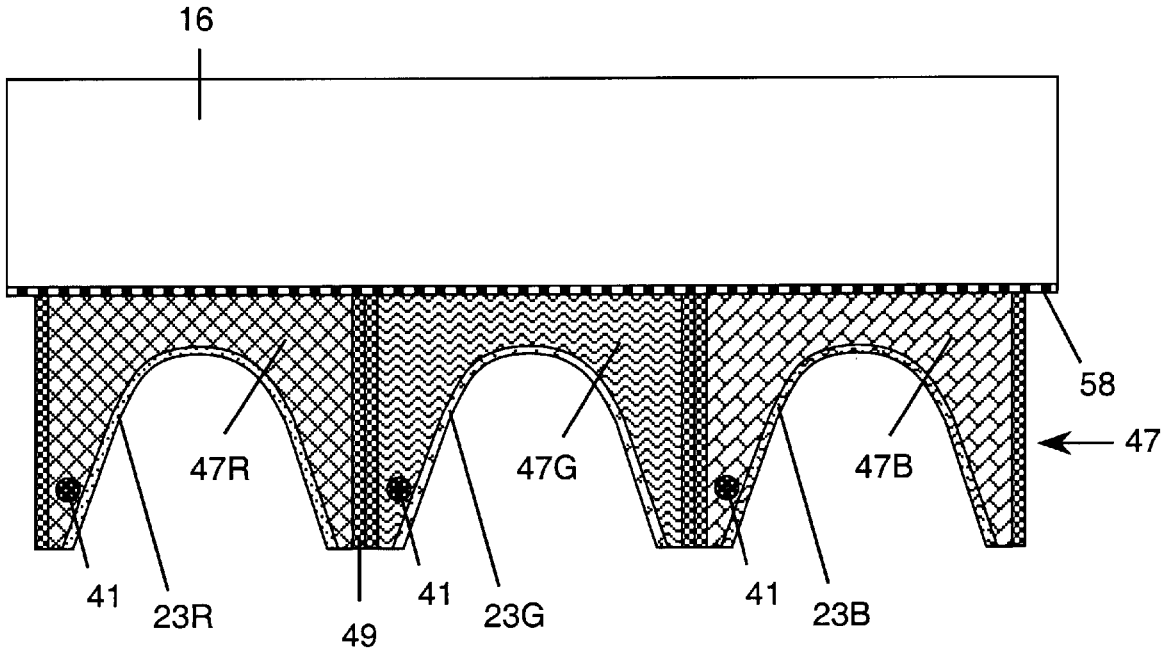
FIG. 17 schematically shows a cross-section of a top fiber array in contact with the top plate, where the top plate is coated with a transparent conductive coating to contain the spreading of the electric field to the plasma channel.

FIG. 17 shows that a film 58 can be added between the top glass plate 16 and the top fiber array 47 to reduce the reflection at that interface. The film 58 could also serve to level the bottom edges of the top fibers 47, such that they rest evenly on the bottom fibers and no gaps exist between adjacent plasma channels. This leveling is created by one top fiber pressing up into the film 58 further than other top fibers, thus allowing for a slight variation in fiber size.

Figure 18:
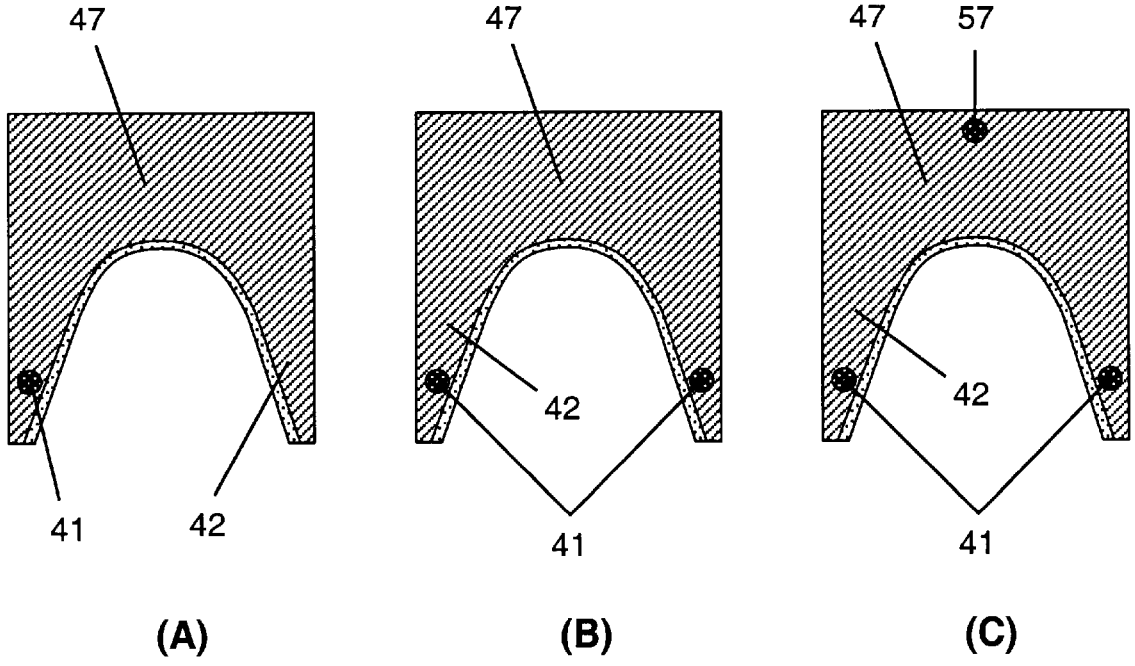
FIG. 18A schematically shows a cross-section of a top fiber with the plasma electrode located in the side of the fiber, which forms the barrier wall.
FIG. 18B schematically shows a cross-section of a top fiber with a pair of plasma electrodes located in the sides of the fiber, which forms the barrier walls.
FIG. 18C schematically shows a cross-section of a top fiber with a pair of plasma electrodes located in the sides of the fiber, which forms the barrier walls, and a third electrode in the top of the fiber to contain the spreading of the electric field.

FIGS. 18A through 18C show a method of lowering the addressing voltage by locating the address electrodes 41 in the wall of the barrier ribs 42, in turn moving them closer to the sustain electrodes. Moving the address electrodes 41 closer to the sustain electrodes create a larger electric field and greatly assist in addressing the plasma. Locating the address electrode 41 in the barrier wall 42 also reduces the amount of blocked light. It may be necessary to move the address electrode 41 into the barrier walls 42 if a large plasma cell depth is created in order to generate a large enough electric field to address the pixel. A single address electrode 41 can be placed in the wall of the barrier rib 42, as shown in FIG. 18A. Two address electrodes 41 located in each barrier wall 42 could be used to even out the electric field during addressing, as shown in FIG. 18B. Moving the address electrode(s) 41 into the wall of the barrier rib may cause a problem with confining the electric field to the plasma cell region to generate a large enough electric field to create ionization. In this case, an additional electrode 57 may need to be added to the bottom of the plasma channel to retard the electric field and confine it to the plasma cell region, as shown in FIG. 18C. This additional retardation electrode 57 could also be contained in the top glass plate 16 as a transparent conductive coating, such as indium tin oxide (ITO).

Figure 19:
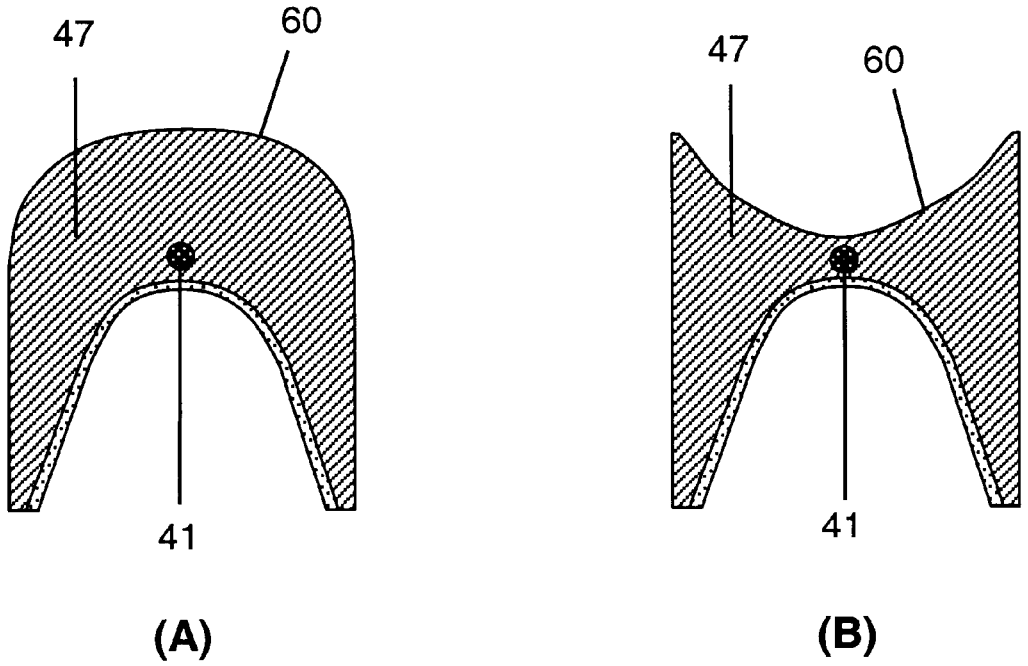
FIG. 19A schematically shows a cross-section of a top fiber with a concave lens built into the surface of the fiber.
FIG. 19B schematically shows a cross-section of a top fiber with a convex lens built into the surface of the fiber.
Figure 20:
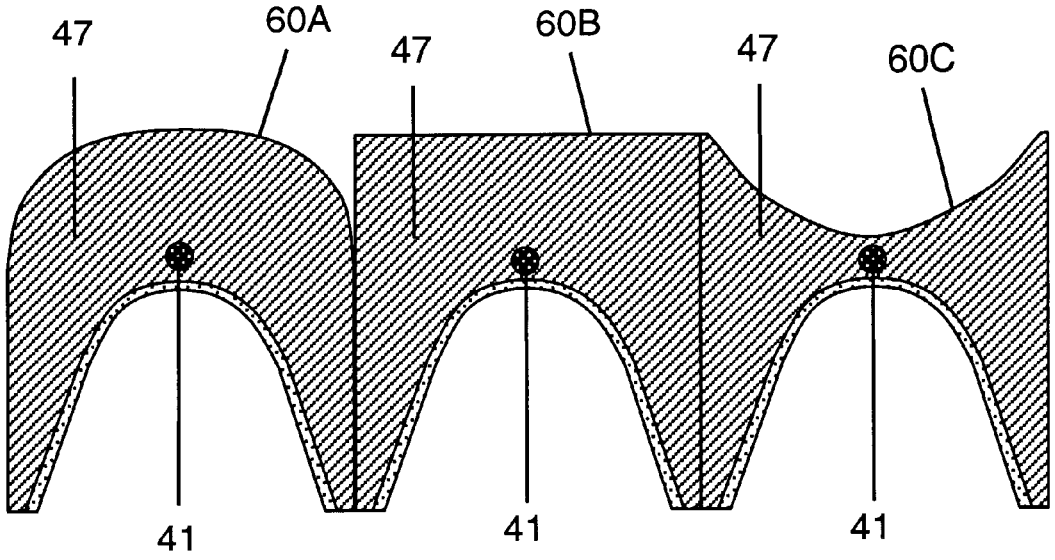
FIG. 20 schematically shows a cross-section of a top fiber array with different shaped surfaces to form a three-dimensional display.

A lens 60 can be designed into the fiber 47, as shown in FIG. 19, and disclosed in U.S. patent application Ser. No. 09/517,353, filed Mar. 2, 2000, entitled "FIBER-BASED DISPLAYS CONTAINING LENS AND METHODS OF MAKING SAME", which is incorporated herein by reference. The lens 60 can serve to help get light out of the display, focus the light coming from the display, or direct the light coming from the display. The lens 60 can be concave, convex or a combination of concave and convex and can be used to create a three-dimensional display or multiple view display. Several top fibers 47 with different lens curvatures 60A, 60B, 60C, can be arrayed to create a display with different viewing characteristics at each fiber location. This multiple fiber lens array shown in FIG. 20 could create a three-dimensional display, multiple view display, or any display that requires controlling the direction or focus of the exiting light. The lens could also be created using different index materials as discussed in U.S. patent application Ser. No. 09/517,353.

Figure 21:
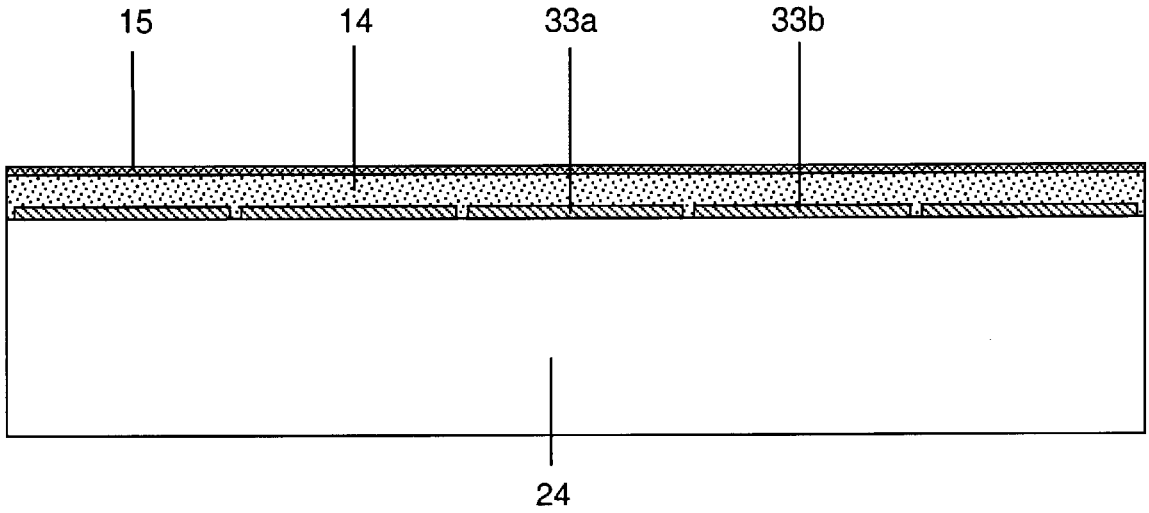
FIG. 21 schematically shows a cross-section of a bottom plate with sustain electrodes covering most of the plate.

A cross-section of the bottom plate 24 and sustain electrodes 33 is shown in FIG. 21. This half of a plasma panel differs from a traditional plasma display panel in that it is on the side facing away from the view and is not required to have a high light transmission. Since the light is transmitted out the top of the display it is preferred that the bottom sustain electrode plate is preferably highly reflective. High reflectivity is not only desired for reflecting visible light generated by the color phosphors 23, but also for reflecting the UV light generated by the plasma. Reflecting the UV light back toward the phosphors increases the amount of photoluminescence, hence increasing the efficiency of the display. Aluminum is the most optimum metal film to reflect both the visible and plasma generated UV light. Aluminum has over 90% reflectivity in the visible and deep UV light, as shown in the table below. Aluminum has a high electrical conductivity, which is very useful when addressing large panels, but has a high sputtering yield. Therefore, the aluminum would have to be covered with a dielectric, such as magnesium fluoride, which would allow for the transmission of UV light and would resist sputtering. Other potential candidates that reflect xenon plasma UV light are molybdenum and silicon. These two metals are much more resistant to sputtering and could be coated on the surface 15 of the bottom plate. The conductive metal films would have to be patterned into small islands to act as small capacitors and to store charge during plasma firing.

| (% Reflectivity) | 147 nm | 173 nm | Visible |
|---|---|---|---|
| Aluminum | 92.7% | 92.6% | 90% |
| Molybdenum | 49.5% | 55% | 50% |
| Silicon | 69% | 69% | 30% |

FIG. 21 also shows that the sustain electrodes 33*a* and 33*b* cover most of the surface of the bottom plate 24. Extending the width of the sustain electrodes 33*a* and 33*b* to cover the majority of the bottom plate spreads the electric field, thus spreading the extent of the plasma. Wider plasmas generate more ionization resulting in higher plasma efficiencies. Interlaced addressing can be used to address the bottom plate sustain electrode structure when a small uniform gap is placed between each sustain electrode 33.

Figure 1:
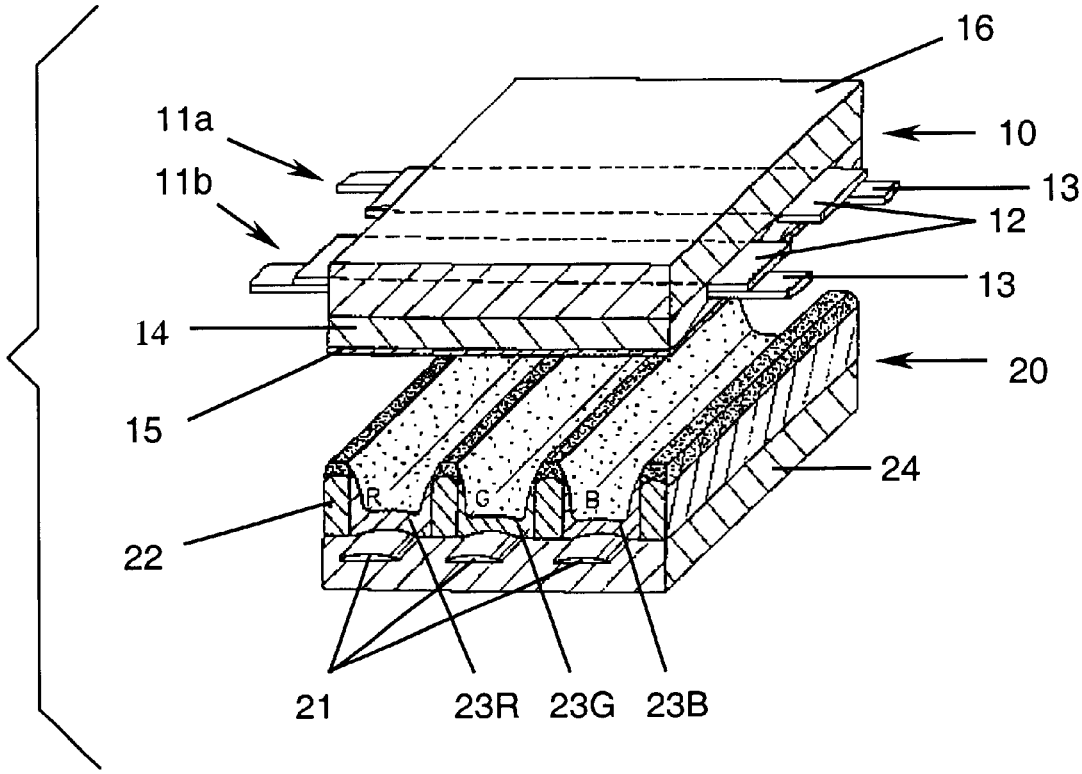
Figure 1 Prior Art
FIG. 1 illustrates a standard plasma display in accordance with the prior art.
Figure 2:
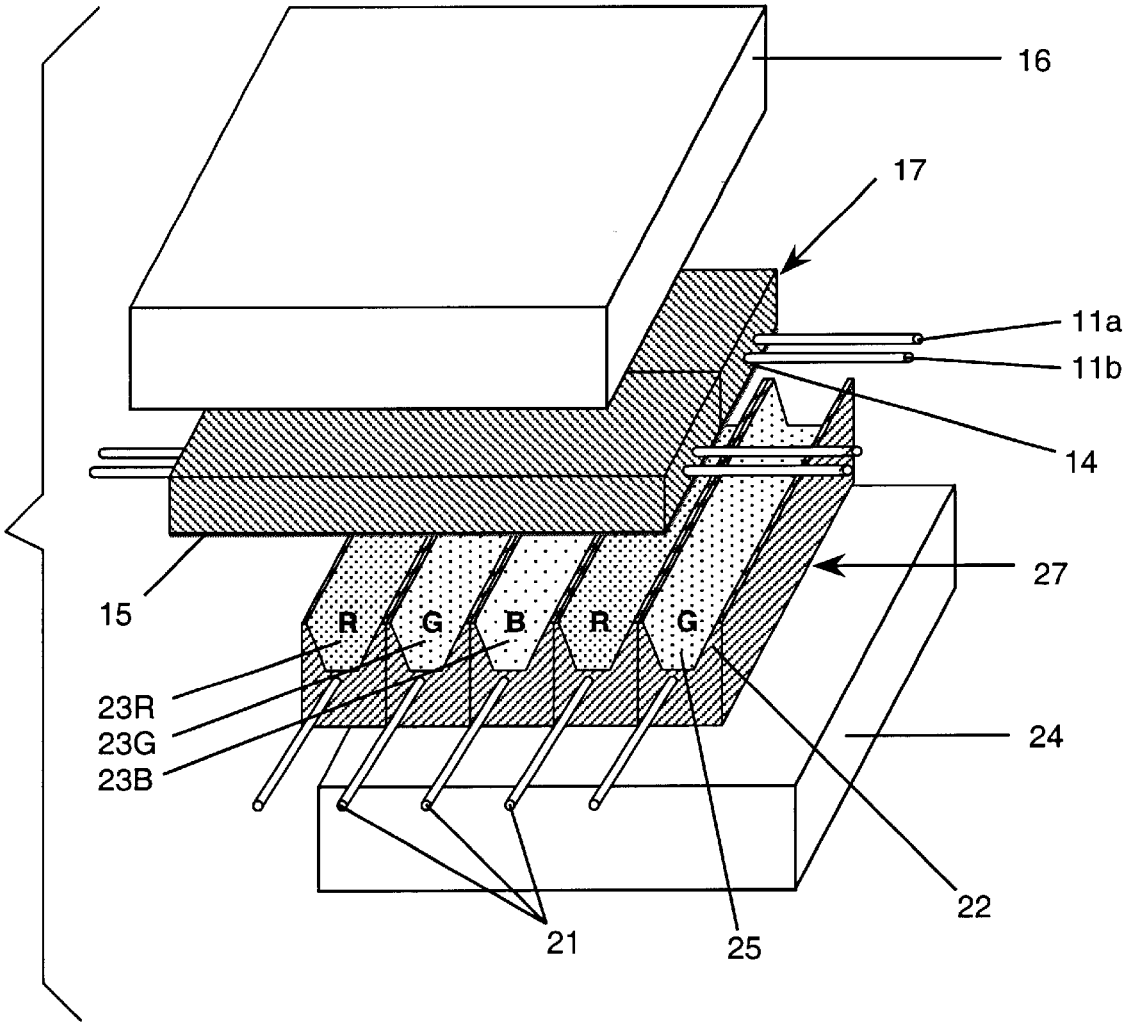
Figure 2 Prior Art
FIG. 2 illustrates a fiber-based plasma display with all functions of the display integrated into the fibers with embedded wire electrodes in accordance with the prior art.
Figure 22:
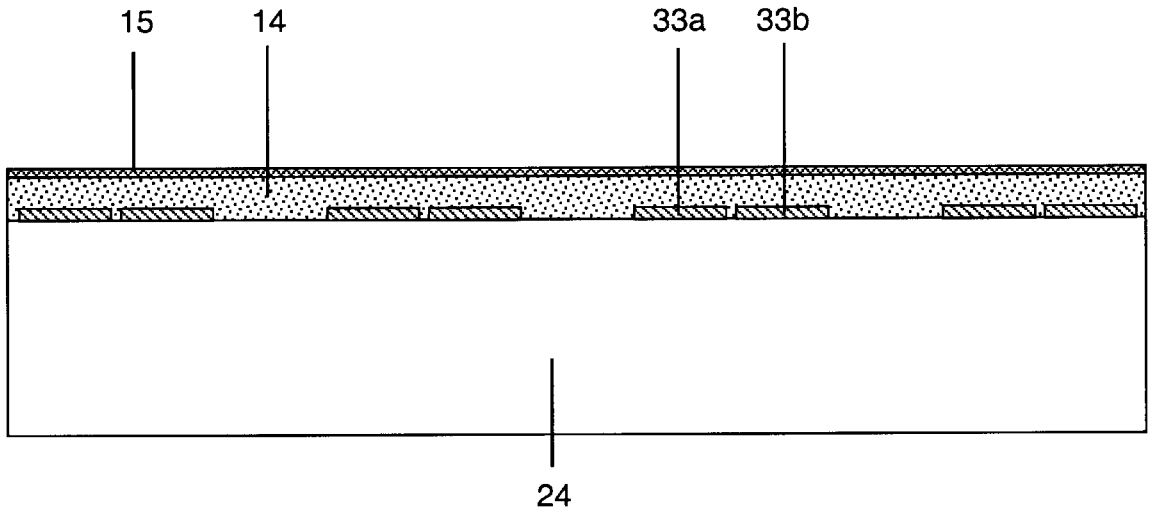
FIG. 22 schematically shows a cross-section of a bottom plate with sustain electrodes and a reflective dielectric layer.

A more traditional sustain electrode structure can be used to generate the plasma within the display, as shown in FIG. 22. Pairs of sustain electrodes 33*a* and 33*b* are deposited and patterned on a glass substrate 24. These sustain electrodes can be completely composed of metal and do not have to be transparent because the generated light is transmitted out through the opposite plate. A traditional plasma display, shown in FIG. 1, uses metal bus electrodes 13 and ITO transparent conductive electrodes 12. The metal bus electrodes 13 are required for a high enough conductance during plasma generation and the transparent ITO electrodes 12 are used to spread the plasma for a higher efficiency display. This duo layer dielectric requires two mask layer process steps where the second layer 13 has to be aligned to the first layer 12. Using a single metal layer 33 only requires one patterning step with no alignment. In addition, a wider single metal layer 33 is more conductive, allowing for the addressability of large panels and allows for a lower cost patterning process, such as silk screening or shadow mask deposition.

Figure 23:
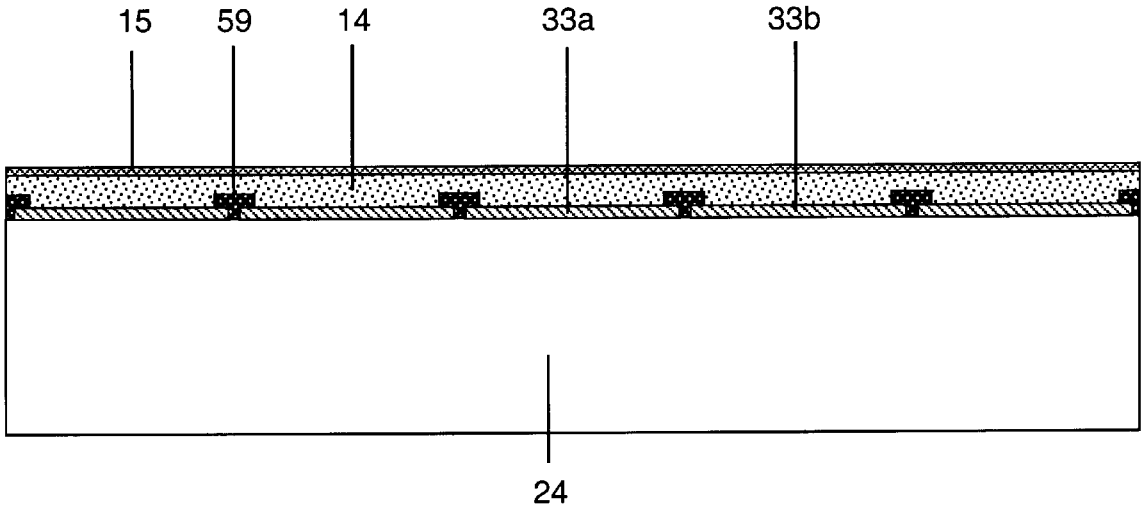
FIG. 23 schematically shows a cross-section of a bottom plate with sustain electrodes and a built-in black matrix.

To enhance the contrast between each line in the display a black matrix 59 can be applied between the sustain electrodes 33*a* and 33*b* on the bottom plate, as shown in FIG. 23. This material 59 could also be composed of a low dielectric material, which tends to create electric field lines that penetrate further into the plasma volume for a given sustain voltage.

Figure 24:
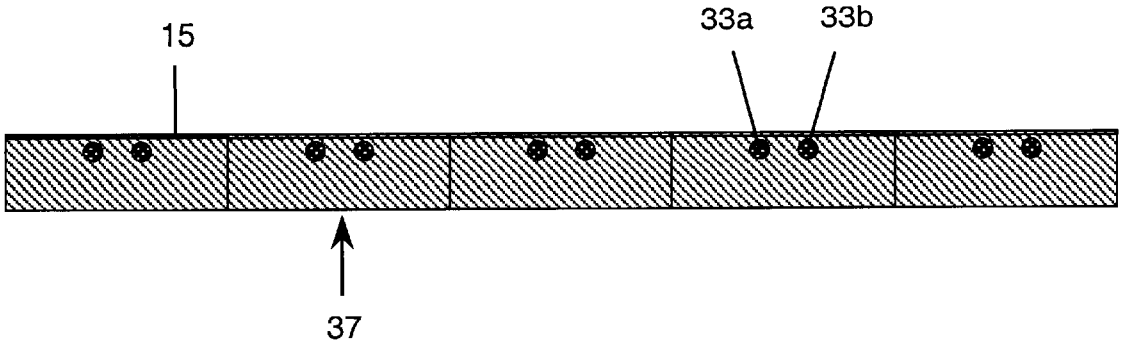
FIG. 24 schematically shows a cross-section of a bottom fiber array with a pair of wire sustain electrodes per fiber.
Figure 25:
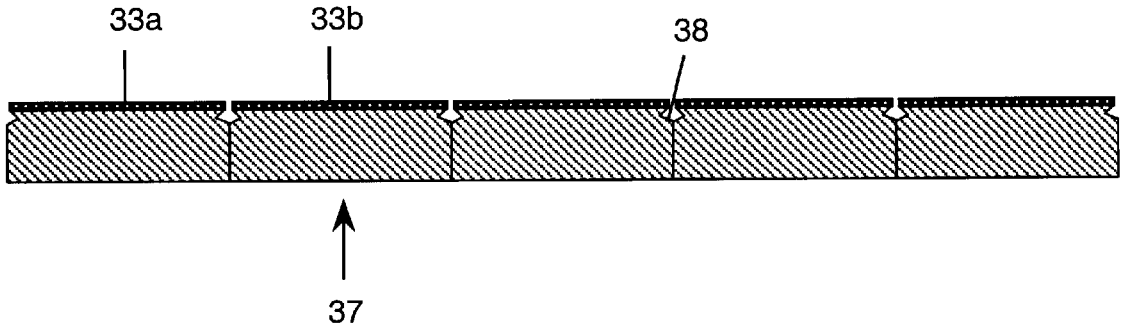
FIG. 25 schematically shows a cross-section of a bottom fiber array with the sustain electrodes coated on the surface of the fibers.

FIG. 24 shows that the sustain electrode structure could also be totally composed in an array of wire 33*a* and 33*b* containing fibers 37. In this case, the wire sustain electrodes 33 could be drawn into the fibers 37 during the draw process and the surface could be coated with an emissive film, such as magnesium oxide. The emissive film could be applied by several different techniques including, but not limited to, physical vapor deposition, powder spraying, and spray pyrolysis. Depositing the emissive film on a high temperature glass fiber allows for a higher temperature deposition or heat treatment, thus yielding a higher quality film with a higher secondary electron emission coefficient. To enhance the reflectivity of the bottom sustain electrode plate, the bottom fibers 37 can be composed of a reflective material, such as an opal glass. An opal glass reflects the visible light generated by the phosphors back toward the top plate.

The metal sustain electrodes 33*a* and 33*b* can also be coated on the surface of the fiber 37. The metal 33 can be coated before, during or after the fiber draw process. Recesses 38 must be added to the sides of the fiber 37 so that the metal 33*a* from one sustain electrode does not contact the metal from the adjacent 33*b* sustain electrode.

Figure 26:
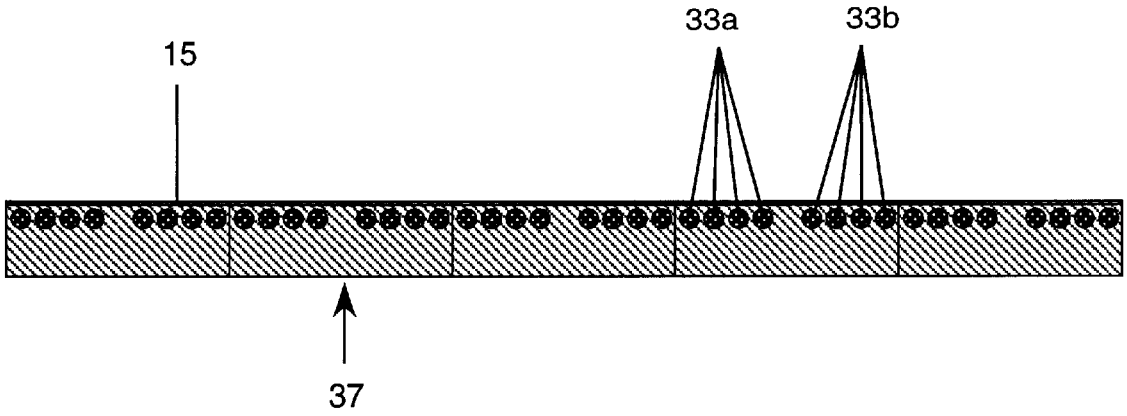
FIG. 26 schematically shows a cross-section of a bottom fiber array with two sets of four wire sustain electrodes per fiber.
Figure 27:
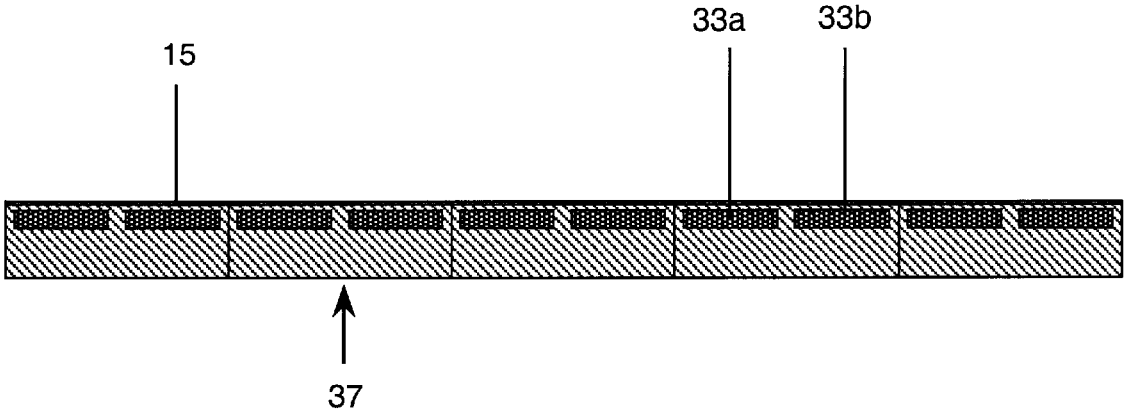
FIG. 27 schematically shows a cross-section of a bottom fiber array with a pair of rectangular wire sustain electrodes per fiber.
Figure 28:
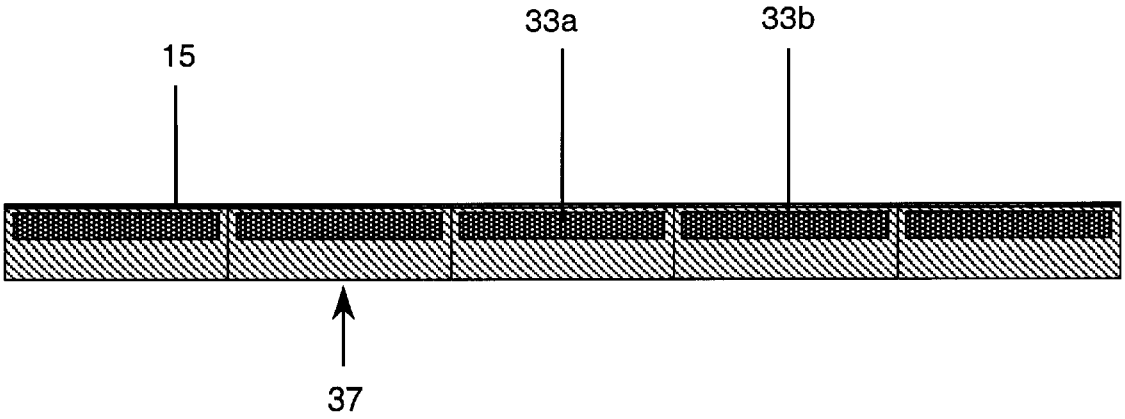
FIG. 28 schematically shows a cross-section of a bottom fiber array with a rectangular wire sustain electrode per fiber.

If wire 33 in fiber 37 is used to create the sustain electrode structure the width of the sustain electrode can be increased by using multiple wires for each sustain electrode 33, as shown in FIG. 26. Using several wire electrodes for each sustain electrode 33 increases the width of the plasma firing, and hence increases the efficiency of the display. A multiple wire sustain electrode 33 also builds redundancy into the panel fabrication process, thus increasing the fabrication yield. The width of the sustain electrodes 33 can also be increased by using a larger rectangular shaped wire electrode, as shown in FIGS. 27 and 28. FIG. 27 shows a pair of sustain electrodes for each fiber where FIG. 28 shows a single wire electrode drawn into each fiber 37.

Figure 29:
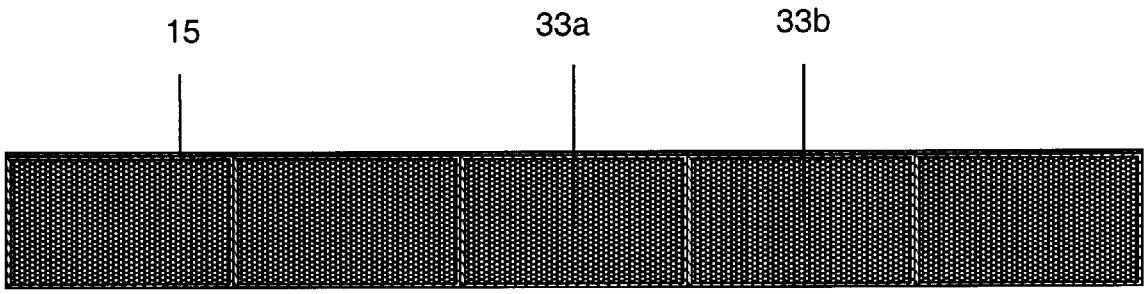
FIG. 29 schematically shows a cross-section of a bottom array of wire sustain electrodes.

The structure in the bottom sustain electrode plate could be created by an array of wires 33*a* and 33*b*, as shown in FIG. 29. In order for these sustain electrodes 33 to be easily arrayed they are preferably to be in the shape of a rectangle. A dielectric layer is applied to the sides to electrically isolate them from each other. A dielectric layer 15 is also applied to the surface of the wire sustain electrodes 33 to isolate them from the plasma and create a capacitive coupling with the plasma. This coating could be applied to the wire or the wire could be oxidized or anodized to form the coating.

Figure 30:
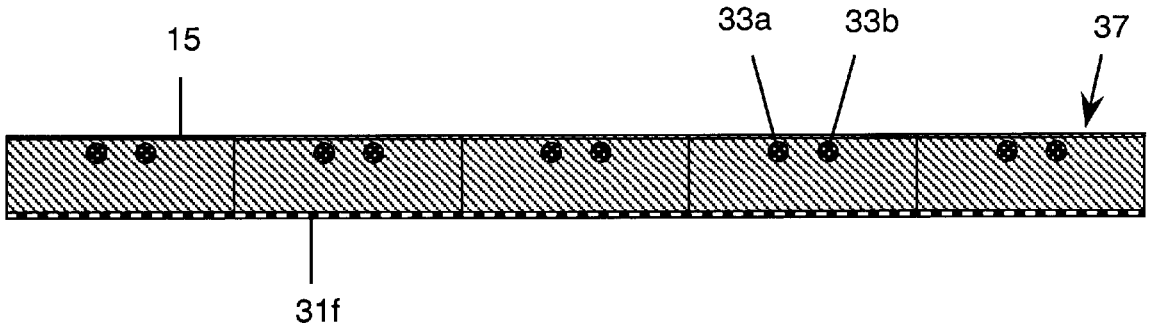
FIG. 30 schematically shows a cross-section of a bottom fiber array with a reflective coating on the bottom surface of the fibers.
Figure 31:
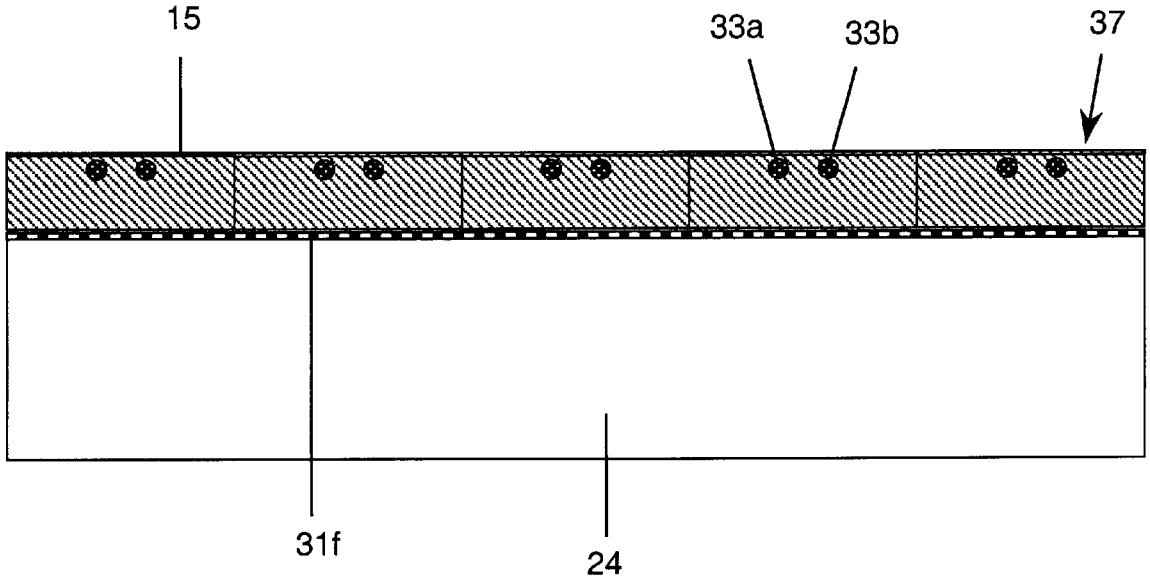
FIG. 31 schematically shows a cross-section of a bottom fiber array place on a substrate coated with a reflective film.
Figure 32:
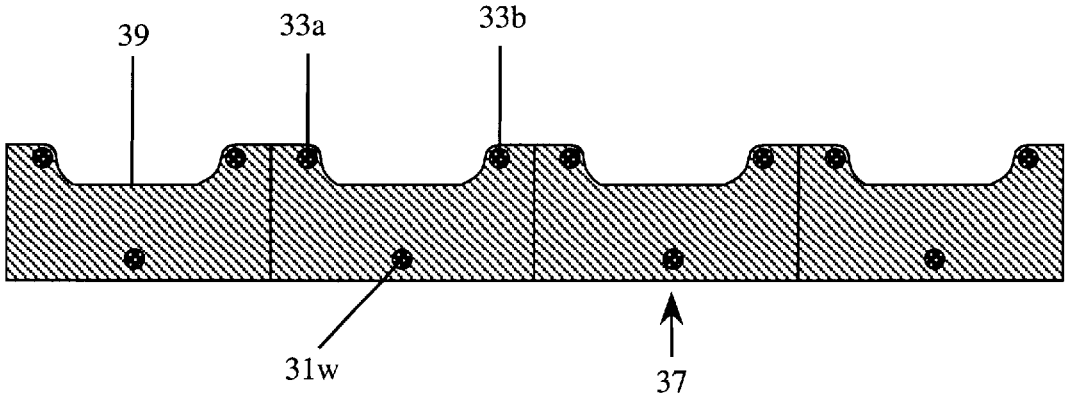
FIG. 32 schematically shows a cross-section of a bottom fiber array with recessed structure on the surface of the fiber to reduce the sustaining voltage of the plasma.

One method of increasing the ionization of the plasma is to repel the electric field far away from the sustain electrodes such that it penetrates far into the plasma volume. This electric field repulsion can be accomplished by applying a conductive film 31*f* to the bottom side of the bottom fibers 37, as shown in FIG. 30. The film 31*f* could also be applied to the bottom glass plate 24, as shown in FIG. 31. The electric field repulsion could also be applied to wire electrodes 31*w* contained within the fiber, as shown in FIG. 32. Controlling the voltage on this film 31*f* or wire 31*w* affects the electric field lines between the sustain electrodes 33*a* and 33*b*. This film 31*f* could also serve as a getter to absorb unwanted molecules and atoms from the plasma gas. Additional structure may have to be built into the bottom fibers 37 to allow for an easy transport of gas species between the getter material 31*f* and the plasma cell 25.

Figure 33:
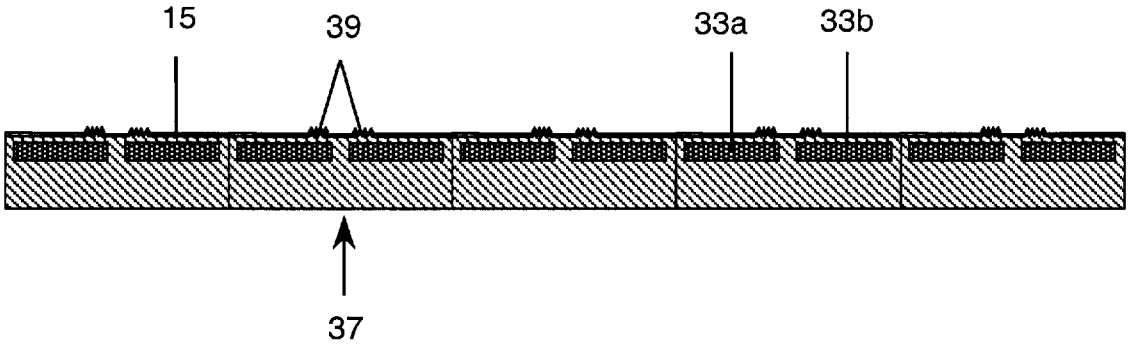
FIG. 33 schematically shows a cross-section of a bottom fiber array with surface structure designed into the fibers to increase the intensity of the local electric field.

Structure 39 can be added to the surface of the fibers 37 to control or enhance the electric field produced by the sustain electrodes 33. This structure 39 could be in the form of an inward protrusion of the surface of the fiber 37 to enhance the strength of the electric field between the sustain electrodes 33*a* and 33*b*, as shown in FIG. 32. The structure 39 could also be in the form of outward protrusion on the surface of the fiber. FIG. 33 shows the surface structure 39 as a sharp outward protrusion that forms ridges to enhance the strength of the local electric field. Using fibers to form the structure of the display allows for many different surface structures to be formed on the fiber 37 to control the strength of the local electric field.

Figure 34:
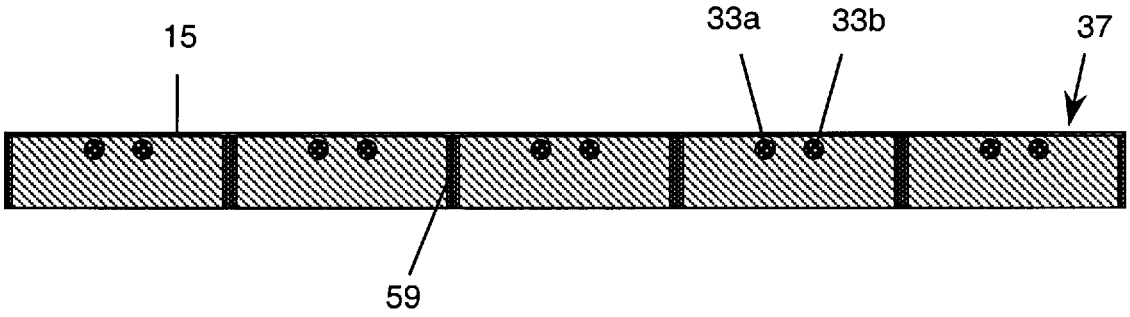
FIG. 34 schematically shows a cross-section of a bottom fiber array with a black matrix built into the sides of the fibers.

FIG. 34 shows a cross-section of a bottom fiber 37 array with a black matrix 59 built into the sides of the fibers 37. A black matrix is used to increase the contrast between individual lines in the display. The black absorbing material 59 can be added to the fiber 37 before, during, or after the fiber draw process.

Figure 35:
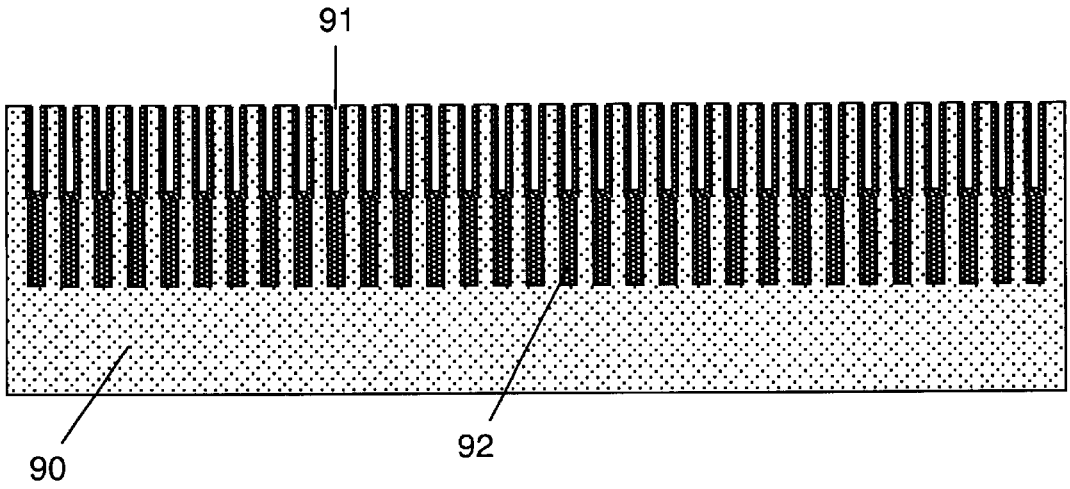
FIG. 35 schematically shows an edge of a circuit board with slots for direct connection of the wire electrodes from the plasma panel.
Figure 36:
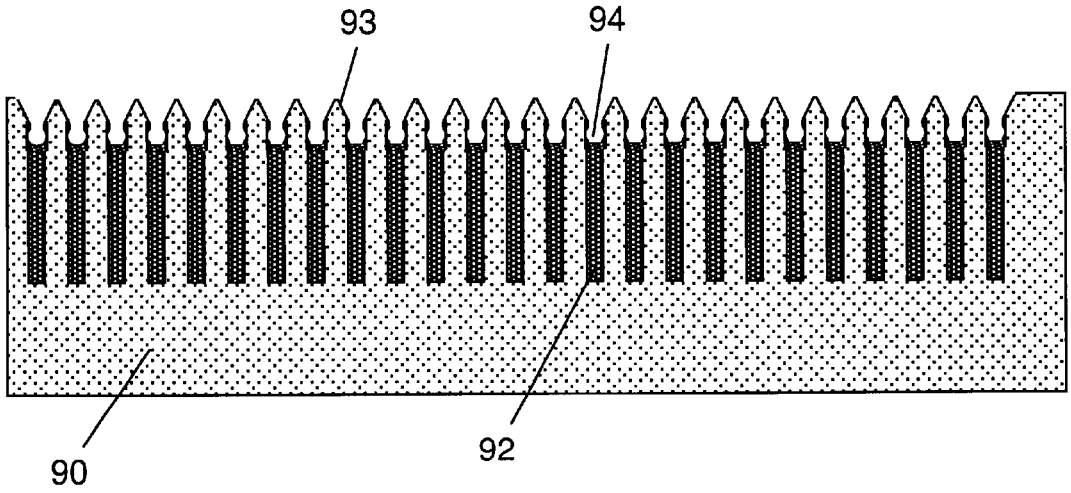
FIG. 36 schematically shows an edge of a circuit board with v-type slots for direct connection of the wire electrodes from the plasma panel.
Figure 37:
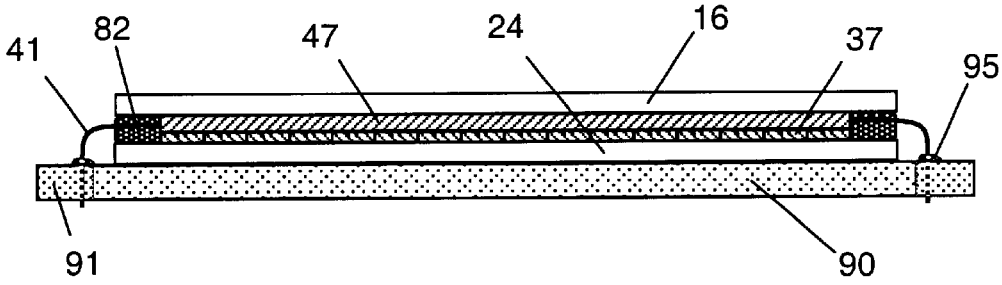
FIG. 37 schematically shows a cross-section of a display with the wire electrode brought out through the frit seal region and connected directly to the drive control system.

FIGS. 35 through 37 show a connection scheme to easily and economically connect the wire electrodes from the plasma panel to the drive control system. The invention has slots 91 on the edge of a circuit board 90 where each slot is connected to an individual row or column high voltage driver in the drive control system, as shown in FIG. 35. The wire electrodes 41 are brought out through the frit seal region 82 and bent 90° into the slots 91 on the edge of the circuit board 90. The wires 41 are then soldered 95 into the slots 91, thus making electrical connection to the high voltage lead 92 on the circuit board 90 that are part of the drive control system, as shown in FIG. 37. An edge connector designed into the circuit board 90 can be created using many different patterns. FIG. 35 shows that the edge connector is composed of slots 91 cut into the circuit board 90 and the slots are plated with metal 92 and the leads are brought out away from the edge of the circuit board 90 to be connected to the high voltage electronic (not shown). FIG. 36 shows a different method of creating the edge connector, where an array of holes 94 are drilled into the circuit board 90 and the holes 94 are then plated with metal 92 and the leads are brought out away from the edge of the circuit board 90 to be connected to the high voltage electronic (not shown). After formation of the circuits on the circuit board 90 the board can be cut such that the holes 94 are opened up and a saw-tooth pattern 93 is created on the edge of the circuit board 90. This saw-tooth pattern is advantageous when connecting the wire electrodes 41 and 33 to the circuit board 90 because they act as a guide to place the wires into the slots or holes.

Most of the examples above use fibers 47 and 37 to form the structure in the display. The fibers 47 and 37 can be easily bent or elastically deformed to form a curved display. Thus, both concave and convex displays can be constructed with curvatures up to 360 degrees.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A fiber plasma display panel comprising a top fiber array sandwiched by a top plate and a bottom plate, where each top fiber in the array has a top and a bottom opposing sides and comprises at least one wire address electrode;

a pair of barrier ribs that define a plasma channel in the bottom side of the top fiber; and a phosphor layer on the plasma channel;

wherein the top fiber array is located on the panel facing a viewer such that light generated from the phosphor layer travels through the top fiber and out the top side to reach the viewer.

2. The fiber plasma display panel of claim 1, wherein the top fiber is colored to add a color filter function to the display.

3. The fiber plasma display panel of claim 1, wherein a surface of the top fiber is colored to add a color filter function to the display.

4. The fiber plasma display panel of claim 1, wherein a thickness of the phosphor layer varies less than 50% across the plasma channel.

5. The fiber plasma display panel of claim 1, wherein each fiber further comprises a reflective material on the sides of the top fibers, wherein the reflective material prevents less than 50% of the generated light from spreading into adjacent top fibers.

6. The fiber plasma display panel of claim 1, wherein each fiber further comprises an absorbing material on the sides of the top fiber, wherein the absorbing material functions as a black matrix and increases a contrast of the display.

7. The fiber plasma display panel of claim 1, wherein each fiber further comprises a partially absorbing material on a top of the top fibers, wherein the partially absorbing material functions as a neutral density filter.

8. The fiber plasma display panel of claim 1, wherein the top plate functions as a neutral density filter.

9. The fiber plasma display panel of claim 1, further comprising a leveling film between the top plate and the top fiber array, where the top plate is placed on a side of the top fiber array that faces the viewer.

10. The fiber plasma display panel of claim 1, wherein at least one address electrode is located in a barrier rib region to reduce an addressing distance between the address electrode and a plurality of sustain electrodes.

11. The fiber plasma display panel of claim 1, further comprising at least one field electrode located above the plasma channel in the top fiber, wherein the field electrode retards an electric field created by a plurality of sustain electrodes and repels the electric field to a plasma cell region.

12. The fiber plasma display panel of claim 11, wherein the field electrode shields an electromotive force escaping out of a top of the display.

13. The fiber plasma display panel of claim 1, wherein the top plate comprises a transparent conductive film, wherein the conductive film retards an electric field created by a plurality of sustain electrodes and repels the electric field to a plasma cell region.

14. The fiber plasma display panel of claim 13, wherein the transparent conductive film shields an electromotive force escaping out of a top of the display.

15. The fiber plasma display panel of claim 1, wherein a surface of the top fiber is curved to add a lens to a surface of the top fiber.

16. The fiber plasma display panel of claim 1, further comprising an array of sustain electrodes fabricated on the bottom plate.

17. The fiber plasma display panel of claim 16, further comprising a low dielectric material between the sustain electrodes to force a plurality of electric field lines to penetrate further into a plasma cell region.

18. The fiber plasma display panel of claim 1, further comprising an array of bottom fibers sandwiched between the top fiber array and the bottom plate, wherein each bottom fiber comprises at least one wire sustain electrode.

19. The fiber plasma display panel of claim 18, wherein the bottom fibers further comprise a thin dielectric layer which separates the wire sustain electrode from a surface of the bottom fibers, wherein a surface of the thin dielectric layer is textured to enhance an electric field from the wire sustain electrode in the textured surface.

20. The fiber plasma display panel of claim 18, wherein a surface of the bottom fiber is curved to effect an electric field from the wire sustain electrodes.

21. The fiber plasma display panel of claim 18, wherein each side of the bottom fiber is absorbing to function as a black matrix.

22. The fiber plasma display panel of claim 1, further comprising an array of fibers sandwiched between the top fiber array and the bottom plate, wherein the array of fibers includes a metal coating that forms a plurality of sustain electrodes.

23. The fiber plasma display panel of claim 1, further comprising an array of wire sustain electrodes sandwiched between the top fiber array and the bottom plate.

24. The fiber plasma display panel of claim 1, wherein the bottom plate comprises an absorbing material, wherein the absorbing material functions as a black matrix.

25. The fiber plasma display panel of claim 1, further comprising an array of bottom fibers sandwiched between the top fiber array and the bottom plate, wherein the array of bottom fibers comprises a plurality of sustain electrodes and a conductive coating on a surface of the bottom fibers to repel an electric field from the sustain electrodes towards a plasma cell region.

26. The fiber plasma display panel of claim 1, further comprising an array of bottom fibers comprising at least one sustain electrode and at least one repulsion electrode to repel an electric field from said sustain electrodes towards a plasma cell region.

27. The fiber plasma display panel of claim 1, wherein a surface of the bottom plate is conductive to repel an electric field from a plurality of sustain electrodes towards a plasma cell region.

28. The fiber plasma display panel of claim 1, wherein a surface of the bottom plate is conductive to shield an electromotive force escaping out of a bottom of the display.

29. The fiber plasma display panel of claim 1, further comprising a getter material within the panel.

30. The fiber plasma display panel of claim 1, wherein the top plate and the bottom plate are curved to create a curved display.

31. A fill color fiber plasma display device having a plurality of subpixels, comprising:

a top fiber array sandwiched by a top glass plate and a bottom glass plate, wherein the top fiber array is disposed on a side facing towards a viewer;

the top fiber array comprising three alternating top fibers, each top fiber comprising:

a pair of barrier ribs that define a plasma channel;

at least one wire address electrode located near a surface of the plasma channel; and a phosphor layer on the surface of the plasma channel;

wherein a luminescent color of the phosphor layer in each of the three alternating top fibers represents a subpixel color of the plasma display;

the bottom plate comprising:

an array of sustain electrodes located on a surface of the bottom plate on a side facing toward the viewer; and a thin dielectric layer separating the sustain electrodes from the surface, the surface being covered by an emissive film;

wherein each subpixel is formed by a crossing of one top fiber and at least one pair of sustain electrodes on the bottom plate; and wherein the plasma display is hermetically sealed with a glass frit and the wire address electrode and the sustain electrode are brought out through the glass frit for connection to a drive control system.

32. The color fiber plasma display device according to claim 31 wherein the drive control system is an erase address drive control system including:

means for storing a charge on each subpixel to turn each subpixel ON; and means for selectively removing the charge from at least one subpixel by applying an erase pulse to its corresponding top fiber address electrode and bottom plate sustain electrodes, thereby turning the subpixel OFF.

33. The color fiber plasma display device according to claim 31 wherein the drive control system is a write address drive control system including:

means for removing a charge from each subpixel, thereby turning each subpixel OFF; and means for adding charge to at least one subpixel by applying a voltage to its corresponding top fiber address electrode and bottom plate sustain electrodes, thereby turning the subpixel ON.

34. The color fiber plasma display device according to claim 31 wherein the drive control system is a ramped voltage address drive control system including:

means for turning each subpixel ON by applying at least one voltage ramp to the bottom fiber sustain electrodes to create a standardized charge at each subpixel; and means for selectively removing the charge from at least one subpixel by applying an erase pulse to its corresponding top fiber address electrode and bottom plate sustain electrodes, thereby turning the subpixel OFF.

35. The color fiber plasma display device according to claim 31, wherein the display is addressed in a progressive mode of operation, where every line in the display is operated per video frame.

36. The color fiber plasma display device according to claim 31, wherein the display is addressed in an interlaced mode of operation, where every other line in the display is operated per video frame.

37. The color fiber plasma display device according to claim 31, wherein an edge of a circuit board of the drive control system comprises a plurality of slots to directly connect the wire address electrodes to the drive control system.

38. A full color fiber plasma display device having a plurality of subpixels, comprising:

a top fiber array and a bottom fiber array sandwiched by two glass plates, the top fiber array and the bottom fiber array being substantially orthogonal and defining a structure of the display, wherein the top fiber array is disposed on a side facing towards a viewer;

the top fiber array including three alternating top fibers, each top fiber comprising:

a pair of barrier ribs that define a plasma channel;

at least one address electrode located near a surface of the plasma channel; and a phosphor layer on the surface of the plasma channel;

wherein a luminescent color of the phosphor layer in each of the three alternating top fibers represents a subpixel color of the plasma display;

the bottom fiber array including a plurality of bottom fibers, each bottom fiber comprising:

at least one sustain electrode located near a surface of the bottom fiber on a side facing toward the viewer; and a thin dielectric layer separating the sustain electrodes from the surface, the surface being covered by an emissive film;

wherein each subpixel is formed by a crossing of one top fiber and one corresponding bottom fiber; and wherein the plasma display is hermetically sealed with a glass frit and the address electrode and the sustain electrodes are brought out through the glass frit for direct connection to a drive control system.

39. The color fiber plasma display device according to claim 38 wherein the drive control system is an erase address drive control system including:

means for storing a charge on each subpixel to turn each subpixel ON; and means for selectively removing the charge from at least one subpixel by applying an erase pulse to its corresponding top fiber address electrode and bottom fiber sustain electrodes, thereby turning the subpixel OFF.

40. The color fiber plasma display device according to claim 38 wherein the drive control system is a write address drive control system including:

means for removing a charge from each subpixel, thereby turning each subpixel OFF; and means for adding charge to at least one subpixel by applying a voltage to its corresponding top fiber address electrode and bottom fiber sustain electrodes, thereby turning the subpixel ON.

41. The color fiber plasma display device according to claim 38 wherein the drive control system is a ramped voltage address drive control system including:

means for turning each subpixel ON by applying at least one voltage ramp to the bottom fiber sustain electrodes to create a standardized charge at each subpixel; and means for selectively removing the charge from at least one subpixel by applying an erase pulse to its corresponding top fiber address electrode and bottom fiber sustain electrodes, thereby turning the subpixel OFF.

42. The color fiber plasma display device according to claim 38, wherein the display is addressed in a progressive mode of operation, where every line in the display is operated per video frame.

43. The color fiber plasma display device according to claim 38, wherein the display is addressed in an interlaced mode of operation, where every other line in the display is operated per video frame.

44. The color fiber plasma display device according to claim 38, wherein an edge of a circuit board of the drive control system comprises a plurality of slots to directly connect the wire address electrodes and wire sustain electrodes to the drive control system.

45. An electronic desplay device comprising;

a flat panel display constructed using at least one fiber array wherein fibers in the fiber array include wire electrodes; and a drive control system where an edge of a circuit board of the drive control system comprises a plurality of slots that are connected to the electronics of the drive control system;

wherein the wire electodes are positioned and soldered into the slots to make electrical connection to the electronics of the drive control system.

* * * * *